US010059106B2

(12) United States Patent
Hagiwara et al.

(10) Patent No.: US 10,059,106 B2
(45) Date of Patent: Aug. 28, 2018

(54) LIQUID EJECTING HEAD AND LIQUID EJECTING APPARATUS

(71) Applicant: SEIKO EPSON CORPORATION, Tokyo (JP)

(72) Inventors: Hiroyuki Hagiwara, Matsumoto (JP); Toshinobu Yamazaki, Niigata (JP); Kentaro Murakami, Matsumoto (JP); Isao Takimoto, Yamagata-mura (JP); Hidekazu Todoroki, Matsumoto (JP); Tomoo Kinoshita, Fujimi-machi (JP); Takayuki Shimosaka, Matsumoto (JP); Kazushige Hakeda, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 132 days.

(21) Appl. No.: 14/920,679

(22) Filed: Oct. 22, 2015

(65) Prior Publication Data

US 2016/0114582 A1 Apr. 28, 2016

(30) Foreign Application Priority Data

Oct. 27, 2014 (JP) ..... 2014-218559

(51) Int. Cl.
*B41J 2/045* (2006.01)
*B41J 2/155* (2006.01)
*B41J 2/14* (2006.01)

(52) U.S. Cl.
CPC ..... *B41J 2/155* (2013.01); *B41J 2/14233* (2013.01); *B41J 2002/14362* (2013.01);
(Continued)

(58) Field of Classification Search
USPC ..... 347/68, 50, 71
See application file for complete search history.

(56) References Cited

U.S. PATENT DOCUMENTS 4,516,140 A * 5/1985 Durkee ..... B41J 2/14233 310/328
4,704,675 A * 11/1987 Jacobs ..... B41J 2/04506 347/14

(Continued)

FOREIGN PATENT DOCUMENTS

JP 2005-262632 9/2005
JP 2010 226020 10/2010

(Continued)

OTHER PUBLICATIONS

European Search Report for Application No. 15181120.5 dated Jun. 8, 2016.

*Primary Examiner* — Matthew Luu
*Assistant Examiner* — Lily Kemathe
(74) *Attorney, Agent, or Firm* — Workman Nydegger

(57) ABSTRACT

Provided is a liquid ejecting head including: a first board on which a driving element for ejecting liquid is installed; a second board which is installed on the surface of the first board and covers the driving element; a wiring board that includes a first surface on which a wiring, where a driving signal is supplied to the driving element, is formed and a second surface that is at the opposite side to the first surface, and where the first surface of a first end section is joined to the surface of the first board; and a filling material which covers the wiring by being formed at least between the first surface and a wall surface of the second board, in which the height of the filling material with respect to the surface of the first board is high at the first surface side in comparison to the second surface side.

18 Claims, 15 Drawing Sheets

(52) U.S. Cl.
CPC .. *B41J 2002/14491* (2013.01); *B41J 2202/11* (2013.01); *B41J 2202/21* (2013.01)

(56) References Cited

U.S. PATENT DOCUMENTS 5,506,611 A * 4/1996 Ujita ..... B41J 2/17503 347/19
5,889,539 A * 3/1999 Kamoi ..... B41J 2/14233 347/50
6,334,668 B1 * 1/2002 Isamoto ..... B41J 2/04541 347/57
7,104,637 B1 * 9/2006 Van Steenkiste .... B41J 2/17509 347/85
7,595,562 B2 * 9/2009 Mizuno ..... B41J 2/14233 257/734
7,753,489 B2 * 7/2010 Imai ..... B41J 2/14072 347/50
7,766,458 B2 * 8/2010 Shinkai ..... B41J 2/14209 29/25.35
8,201,934 B2 * 6/2012 Kawakami ..... B41J 2/175 347/100
8,322,823 B2 * 12/2012 Owaki ..... B41J 2/14233 347/50
8,398,214 B2 * 3/2013 Okubo ..... B41J 2/14233 347/68
8,567,896 B2 * 10/2013 Ueshima ..... B41J 2/04501 347/14
8,851,621 B2 * 10/2014 Sato ..... B41J 2/14201 174/259
8,851,633 B2 * 10/2014 Kubo ..... B41J 2/14209 347/57
9,022,527 B2 * 5/2015 Torimoto ..... B41J 2/14233 347/50
9,259,928 B2 * 2/2016 Torimoto ..... B41J 2/14233
9,579,892 B2 * 2/2017 Yoda ..... B41J 2/14233
2002/0105567 A1 * 8/2002 Yamada ..... B41J 2/14209 347/87
2002/0130928 A1 * 9/2002 Kondo ..... B41J 2/14274 347/68
2003/0090540 A1 * 5/2003 Shimizu ..... B41J 2/14209 347/49
2004/0061147 A1 * 4/2004 Fujita ..... G06F 11/261 257/232
2004/0239733 A1 * 12/2004 Hattori ..... B29C 65/08 347/85
2005/0012785 A1 * 1/2005 Furuhata ..... B41J 2/14233 347/68
2005/0018018 A1 1/2005 Aschoff et al.
2005/0062806 A1 * 3/2005 Terakura ..... B41J 2/04541 347/72
2007/0042613 A1 * 2/2007 Yoda ..... B41J 2/14233 439/34
2007/0229606 A1 * 10/2007 Taira ..... B41J 2/14209 347/71
2009/0211790 A1 * 8/2009 Yokouchi ..... B41J 2/14233 174/254
2009/0213189 A1 * 8/2009 Okubo ..... B41J 2/14233 347/71
2010/0079557 A1 * 4/2010 Okubo ..... B41J 2/14233 347/71
2010/0097428 A1 * 4/2010 Owaki ..... B41J 2/14233 347/50
2011/0018943 A1 * 1/2011 Owaki ..... B41J 2/14233 347/54
2011/0084996 A1 * 4/2011 Hirato ..... B41J 2/0451 347/10
2012/0092408 A1 * 4/2012 Yamamori ..... B41J 2/04528 347/17
2012/0250040 A1 * 10/2012 Yamazaki ..... B41J 2/2135 358/1.8
2013/0258001 A1 10/2013 Sato et al.
2014/0240398 A1 * 8/2014 Yamashita ..... B41J 2/04541 347/40
2014/0290842 A1 * 10/2014 Arai ..... G11B 5/127 156/247
2014/0292942 A1 * 10/2014 Torimoto ..... B41J 2/14233 347/68
2015/0138739 A1 * 5/2015 Hishiki ..... H05K 3/305 361/760

FOREIGN PATENT DOCUMENTS

JP 2010 228249 10/2010
JP 2011 187788 9/2011
JP 2012 081644 4/2012
JP 2013-136215 7/2013
JP 2013-138999 7/2013
JP 2013-202857 10/2013
JP 2013-202938 10/2013
JP 2014-054743 3/2014
JP 2014 054743 3/2014

* cited by examiner

END SECTION

CENTER SECTION

LIQUID EJECTING HEAD AND LIQUID EJECTING APPARATUS

CROSS-REFERENCE TO RELATED APPLICATIONS

This application claims priority to Japanese Patent Application No. 2014-218559 filed on Oct. 27, 2014. The entire disclosure of Japanese Patent Application No. 2014-218559 is hereby incorporated herein by reference.

BACKGROUND

1. Technical Field

The present invention relates to a technique for ejecting liquid such as ink.

2. Related Art

Various structures of a liquid ejecting head which ejects liquid such as ink from a nozzle are proposed in the related art. For example, JP-A-2013-202857 discloses a liquid ejecting head which is equipped with a protective board that covers a plurality of piezoelectric elements on the surface of a vibration plate, and a flexible wiring board which is joined to an end section on the surface of the vibration plate via an opening section which passes through the protective board. A wiring for supplying a driving signal to each piezoelectric element is formed on the wiring board. An epoxy-based and a silicone-based adhesive is filled into a space inside the opening section of the protective board as a filling material.

The filling material is filled into the opening section of the protective board to the extent of a sufficient filling amount which is equal to the height of the filling material at one side and another side of the wiring board. In the configuration above, for example, it is possible that stress is generated in each component of the liquid ejecting head due to contraction of the filling material during curing, and as a result, that deformation, peeling, or the like is caused in each component. Meanwhile, if the filling material is omitted, the problem of stress which is caused by contraction of the filling material is eliminated, but there is the problem such as corrosion of the wiring occurring caused by the wiring on the wiring board coming into contact with outside air due to exposure. For example, when utilizing a vulcanized material (for example, butyl rubber) in a liquid ejecting apparatus which ejects liquid ink, it is possible for the wiring to be corroded by gas (outgas) being generated which contains sulfur in a high-temperature and high-humidity environment.

SUMMARY

An advantage of some aspects of the invention is to suppress stress which is caused by compression of filling material which covers a wiring on a wiring board.

Aspect 1

According to a preferred aspect (Aspect 1) of the invention, there is provided a liquid ejecting head including: a first board on which a driving element for ejecting liquid is installed; a second board which is installed on the surface of the first board and covers the driving element; a wiring board that includes a first surface on which a wiring, where a driving signal is supplied to the driving element, is formed and a second surface that is at the opposite side to the first surface, and where the first surface of a first end section is joined to the surface of the first board; and a filling material which covers the wiring by being formed at least between the first surface and a wall surface of the second board, in which the height of the filling material with respect to the surface of the first board is high at the first surface side in comparison to the second surface side. In Aspect 1, the height of the filling material with respect to the surface of the first board is lower at the second surface side in comparison to the first surface side of the wiring board. Accordingly, it is possible to suppress stress which is caused by contraction of the filling material in comparison to a configuration in which the filling material is also formed up to an equal height at the second surface side to at the first surface side of the wiring board. Meanwhile, the height of the filling material with respect to the surface of the first board is higher at the first surface side in comparison to the second surface side of the wiring board. Accordingly, the wiring on the first surface is covered by the filling material across a wide range in comparison to a case in which the height of the filling material at the first surface side of the wiring board is suppressed to be an equal height to the second surface side. Accordingly, it is possible to suppress the problem such as corrosion of a wiring which is, for example, caused by adhesion with outside air or water. Here, the filling material covers the wiring between the first surface and the wall surface of the second board if the filling material covers the wiring across a boundary of a bend in a case where a portion which is joined to the surface of the first board out of the wiring board is distinguished as a portion which is not joined to the surface of the first board due to the bend of the wiring board.

Aspect 2

In the liquid ejecting head of a preferred example (Aspect 2) according to Aspect 1, the filling material may be filled inside a space which is enclosed by a surface of the first board, a wall surface of the second board, and the first surface of a portion which is bent with respect to the first end section out of the wiring board. In Aspect 2, it is advantageous in that it is possible to effectively utilize a space which is enclosed by the surface of the first board, the wall surface of the second board, and the first surface of the wiring board in formation of the filling material.

Aspect 3

In the liquid ejecting head of a preferred example (Aspect 3) according to Aspect 1 or Aspect 2, the height of the filling material at the second surface side with respect to the surface of the first board may be low in the center section of the wiring board in a width direction in comparison to the end section of the wiring board in the width direction. In Aspect 3, since the height of the filling material at the second surface side of the wiring board is low at the center section in comparison to the end section of the wiring board in the width direction, the effect described above where stress, which is caused by contraction of the filling material, is reduced is particularly remarkable in comparison to the configuration in which the filling material is also formed at an equal height at the center section of the wiring board in the width direction to at each end section.

Aspect 4

According to another preferred aspect (Aspect 4) of the invention, there is provided a liquid ejecting head including: a first board on which a driving element for ejecting liquid is installed; a second board which is installed on the surface of the first board and covers the driving element; a wiring board that includes a first surface on which a wiring, where a driving signal is supplied to the driving element, is formed and a second surface that is at the opposite side to the first surface, and where the first surface of a first end section is joined to the surface of the first board; and a filling material which covers a bent portion of the wiring board by being formed at least between the first surface and a wall surface of the second board using an adhesive in order to join the wiring board and the first board. In Aspect 4, since the filling material is formed so as to cover the wiring between the first surface and the wall surface of the second board (that is, an adhesive is applied as the filling material) using an adhesive in order to join the wiring board and the first board, the amount of filling material formed on the surface of the first board is reduced in comparison to the configuration in which the adhesive for the joint between the wiring board and the first board individually forms the filling material. Accordingly, it is possible to suppress stress caused by contraction of the filling material.

Aspect 5

In the liquid ejecting head of a preferred example (Aspect 5) according to any one of Aspects 1 to 4, the wiring on the wiring board may include a first layer and second layer which is formed by plating with respect to the first layer. In Aspect 5, since the second layer is formed by plating with respect to the first layer, it is possible to suppress the problem such as corrosion of the first layer even if the wiring on the first surface of the wiring board is not covered by the filling material across the entire range.

Aspect 6

In the liquid ejecting head of a preferred example (Aspect 6) according to any one of Aspects 1 to 5, the filling material may be formed by an epoxy-based adhesive. In Aspect 6, since the filling material is formed by an epoxy-based adhesive, it is advantageous in that it is possible to suppress the problem such as corrosion of the wiring due to coming into contact with gas which has passed through the filling material in comparison to the configuration in which the filling material is formed, for example, by a silicone-based adhesive with high permeability with respect to gas of sulfur or the like.

Aspect 7

In the liquid ejecting head of a preferred example (Aspect 7) according to any one of Aspects 1 to 6, the wiring board may include the first end section in which a plurality of connection terminals are arranged at a first pitch and a second end section in which a plurality of connection terminals are arranged at a second pitch which is wider than the first pitch, and the filling material may cover the first end section. For example, the effect of corrosion and the like which is caused by coming into contact with outside air particularly becomes a problem (for example, a short between wirings) based on a configuration in which multiple wirings are densely arranged at a narrow pitch. In the invention, as described above, since corrosion of the wiring is effectively prevented by the wiring on the first surface of the wiring board being covered by the filling material across a wide range, it is possible to suppress a problem such as corrosion of each wiring even in Aspect 7 in which a plurality of wirings are arranged at a narrow pitch in the first end section.

Aspect 8

In the liquid ejecting head of a preferred example (Aspect 8) according to any one of Aspects 1 to 7, the filling material may cover an end surface of the wiring board in a direction in which the wiring extends. In Aspect 8, since the end surface in the direction in which the wiring extends is also covered by the filling material, the effect described above in which it is possible to suppress the problem such as corrosion of the wiring is particularly remarkable.

Aspect 9

In the liquid ejecting head of a preferred example (Aspect 9) according to any one of Aspects 1 to 8, the first end section of the wiring board may be joined to an installation surface using the adhesive, and the filling material may cover a portion of the wiring on the wiring board, the position not being covered by the adhesive. In Aspect 9, since the filling material is formed so as to cover a portion of the wiring on the wiring board, the position not being covered by the adhesive of a joint of the wiring board, it is advantageous in that it is possible to reduce the usage amount of filling material.

Aspect 10

According to still another preferred aspect (Aspect 10) of the invention, there is provided a liquid ejecting apparatus including the liquid ejecting head according to each aspect described above. A printing apparatus which ejects ink is a preferred example of the liquid ejecting apparatus, but the applications of the liquid ejecting apparatus according to the invention are not limited thereto.

Aspect 11

The liquid ejecting apparatus of a preferred example (Aspect 11) according to Aspect 10 may further include a vulcanized member. A member to which solvent resistance is added by vulcanization is preferably utilized at a location at which liquid ink comes in contact. Meanwhile, although it is possible for gas to be generated which includes sulfur from the member which is vulcanized, according to the invention, it is advantageous in that it is possible to prevent corrosion and the like of the wiring which is caused by coming into contact with gas by covering the wiring on the first surface of the wiring board across a wide range using the filling material.

Aspect 12

According to still another preferred aspect (Aspect 12) of the invention, there is provided a production method of a liquid ejecting head which includes a first board on which a driving element for ejecting liquid is installed, a second board which is installed on the surface of the first board and covers the driving element, and a wiring board that includes a first surface on which a wiring, where a driving signal is supplied to the driving element, is formed and a second surface that is at the opposite side to the first surface, and where the first surface of a first end section is joined to the surface of the first board, the method including: arranging a filling material on a surface of the first board; and moving the filling material inside a space which is enclosed by a surface of the first board, a wall surface of the second board, and the first surface of the wiring board. According to the method above, it is possible to simply form the filling material within a space which is enclosed by the surface of the first board, the wall surface of the second board, and the first surface of the wiring board by causing the filling material which is arranged on the surface of the first board to move.

Aspect 13

According to still another preferred aspect (Aspect 13) of the invention, there is provided a production method of a liquid ejecting head which includes a first board on which a driving element for ejecting liquid is installed, a second board which is installed on the surface of the first board and covers the driving element, and a wiring board that includes a first surface on which a wiring, where a driving signal is supplied to the driving element, is formed and a second surface that is at the opposite side to the first surface, and where the first surface of a first end section is joined to the surface of the first board, the method including: joining the wiring board and the first board using an adhesive; and covering a bent portion of the wiring board between the first surface and a wall surface of the second board with the adhesive. According to the method above, it is possible to form the filling material which covers a bent portion of the wiring board between the first surface and the wall surface of the second board using an adhesive in order to join the wiring board and the first board.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Figure 1:
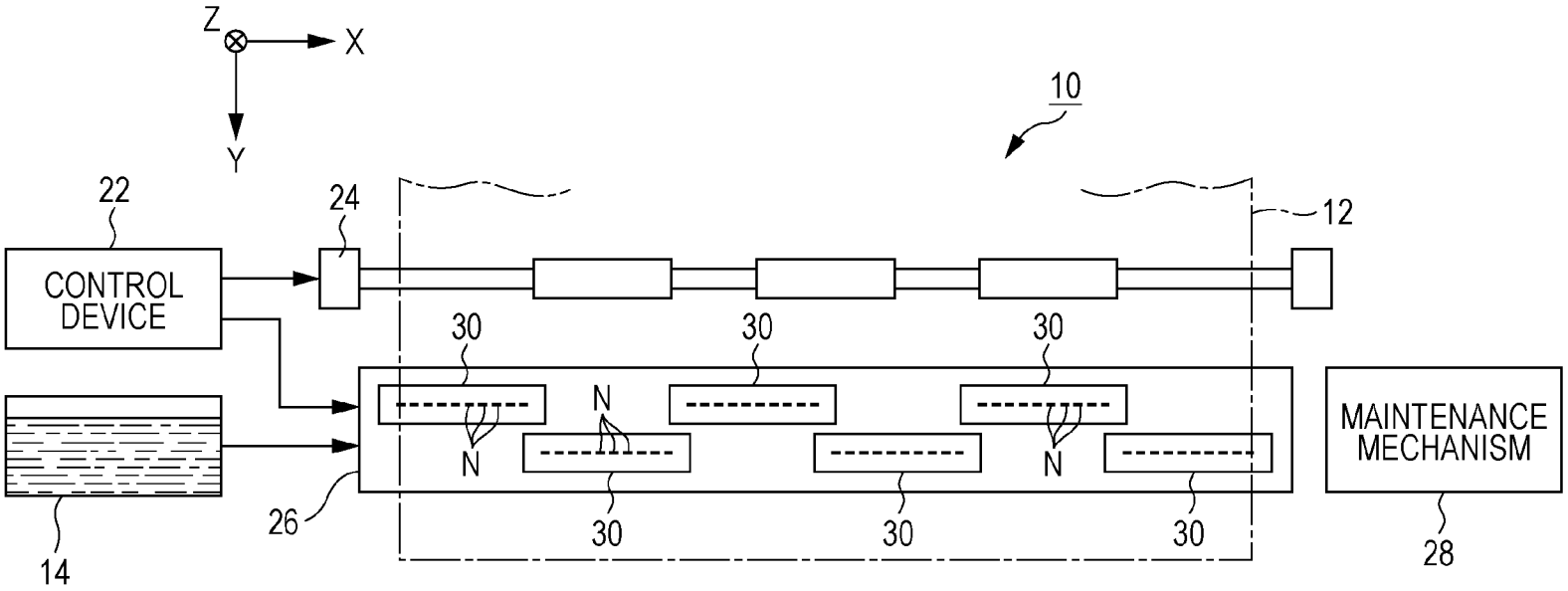
FIG. 1 is a configuration diagram of a printing apparatus according to a first embodiment of the invention.

FIG. 1 is a partial configuration diagram of an ink jet type printing apparatus 10 according to a first embodiment of the invention. The printing apparatus 10 of the first embodiment is a liquid ejecting apparatus which ejects ink, which is an exemplification of a liquid, onto a medium (ejection target) 12 such as printing paper and is equipped with a control device 22, a transport mechanism 24, a liquid ejecting unit 26, and a maintenance mechanism 28. As exemplified in FIG. 1, a liquid container (cartridge) 14 which retains ink of a plurality of colors is mounted in the printing apparatus 10. Ink which is retained in the liquid container 14 of the first embodiment is liquid (solvent) ink with suitable high weather resistance for industrial applications.

The control device 22 collectively controls each of the components of the printing apparatus 10. In detail, the control device 22 outputs a control signal to each component by generating the control signal in order to control the operation of each of the transport mechanism 24, the liquid ejecting unit 26, and the maintenance mechanism 28. The transport mechanism 24 transports the medium 12 in the Y direction under control by the control device 22. The liquid ejecting unit 26 ejects ink supplied from the liquid container 14 onto the medium 12 under control by the control device 22. The liquid ejecting unit 26 of the first embodiment is a line head in which a plurality of liquid ejecting heads 30 are arranged in the X direction which is orthogonal to the Y direction. A plurality of nozzles N are formed on a surface (hereinafter referred to as an "ejection surface" which is to oppose the medium 12 out of each liquid ejecting head 30. A desired image is formed on the surface of the medium 12 by each of the liquid ejecting heads 30 ejecting ink onto the medium 12 from each nozzle in parallel with transport of the medium 12 by the transport mechanism 24. Here, a direction which is perpendicular to the X-Y horizontal plane (the horizontal plane which is parallel to the surface of the medium 12) is represented below as the Z direction. The ejection direction of ink by the liquid ejecting head 30 is equivalent to the Z direction.

The maintenance mechanism 28 is utilized in maintenance of the liquid ejecting unit 26. As exemplified in FIG. 2, the maintenance mechanism 28 of the first embodiment is equipped with a wiper 282, a suction section 284, and a discharge section 286. The wiper 282 wipes away ink which is adhered to the ejection surface of each liquid ejecting head 30. The suction section 284 is a mechanism which suctions ink inside each liquid ejecting head 30 from each nozzle, and, for example, includes a cap 284A which seals the ejection surface of the liquid ejecting head 30 and a pump 284B which suctions the inside of the cap 284A. The discharge section 286 is configured by a tube body 286A and a container 286B which discharge and retain ink which the wiper 282 wipes away or ink which the suction section 284 suctions. Each member (for example, the wiper 282, the cap 284A, the pipe body 286A, and the container 286B) which is able to come into contact with liquid ink out of the maintenance mechanism 28 are formed by a vulcanized material with solvent resistance (for example, butyl rubber) in order to prevent damage due to adhering of liquid ink. In a configuration in which the printing apparatus 10 includes the member which is vulcanized (hereinafter referred to as a "vulcanized member") as exemplified above, it is possible to generate gas (outgas) which includes sulfur from the vulcanized member particularly in a high-temperature and high-humidity environment.

Figure 3:
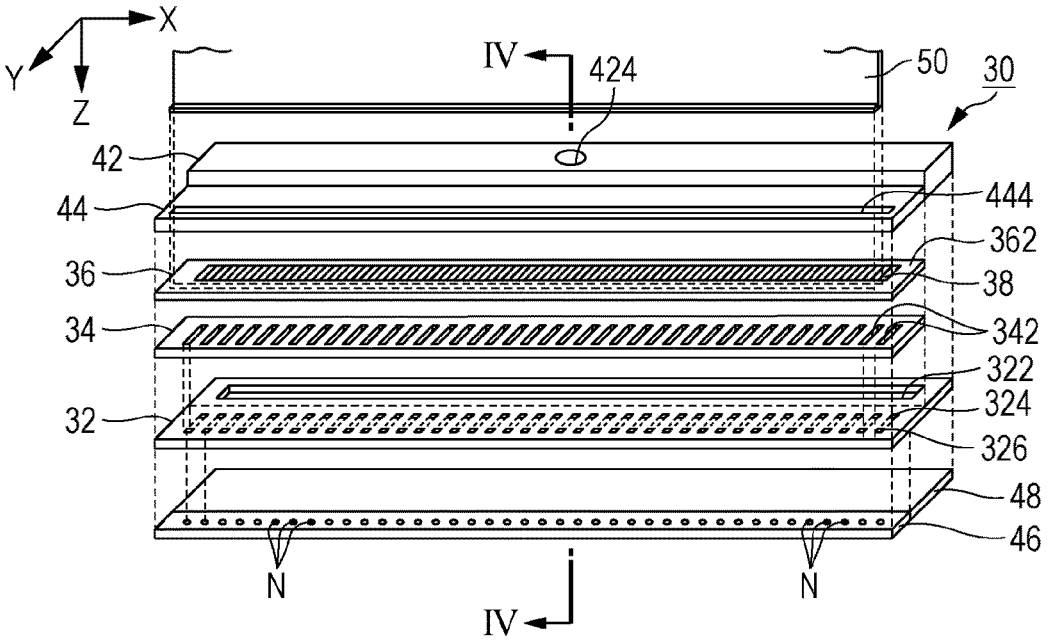
FIG. 3 is an exploded perspective diagram of a liquid ejecting head.
Figure 4:
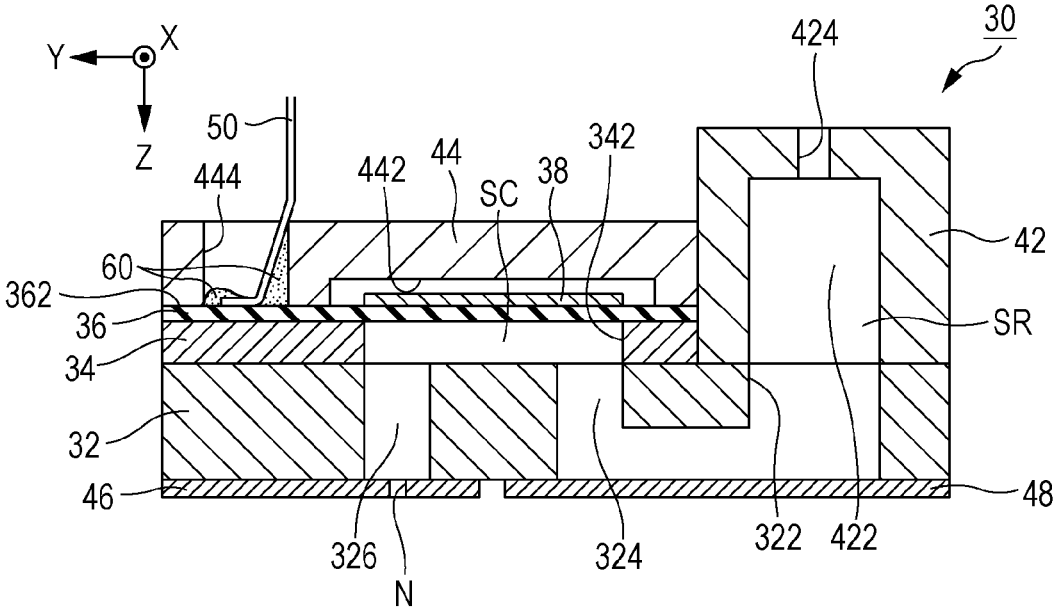
FIG. 4 is a sectional diagram of the liquid ejecting head (a sectional diagram along line IV-IV in FIG. 3).

FIG. 3 is an exploded perspective diagram of one arbitrary liquid ejecting head 30, and FIG. 4 is a sectional diagram (a horizontal cross section on the Y-Z horizontal plane) along line IV-IV in FIG. 3. As exemplified in FIG. 3 and FIG. 4, the liquid ejecting head 30 of the first embodiment has a structure (is a head chip) in which a pressure chamber substrate 34, a vibration plate 36, a sealing plate 44, and a casing 42 are installed on an upper surface at the negative side in the Z direction on a flow path substrate 32, and a nozzle plate 46 and a compliance section 48 are installed on an upper surface at the positive side in the Z direction on the flow path substrate 32. Each component of the liquid ejecting head 30 is a member with a substantially flat plate shape with a long dimension in the X direction in outline, and are fixed to one another utilizing, for example, an adhesive. A plurality of the nozzles N are formed on the nozzle plate 46.

The flow path substrate 32 is a member with a flat plate shape for forming an ink flow path. An opening section 322, a supply flow path 324, and a linking flow path 326 are formed on the flow path substrate 32 of the first embodiment. As exemplified in FIG. 3, the opening section 322 is a through hole with a long dimension in the X direction which links across the plurality of nozzles N, and the supply flow path 324 and the linking flow path 326 are through holes which are formed in each nozzle N.

The casing 42 is fixed to the surface at the negative side in the Z direction on the flow path substrate 32. As exemplified in FIG. 4, an accommodating section 422 and an introduction flow path 424 are formed in the casing 42 of the first embodiment. The accommodating section 422 is a concave section with an outer form which corresponds to the opening section 322 of the flow path substrate 32, and the introduction flow path 424 is a through hole which links to the accommodating section 422. As exemplified in FIG. 4, the space, which links the opening section 322 of the flow path substrate 32 and the accommodating section 422 of the casing 42 with one another, functions as a liquid retaining chamber (reservoir) SR which retains ink that is supplied from the liquid container 14 via the introduction flow path 424. The compliance section 48 in FIG. 4 configures the bottom surface of the liquid retaining chamber SR and suppresses pressure variation in ink inside the liquid retaining chamber SR.

The pressure chamber substrate 34 in FIG. 3 is a flat plate member in which an opening section 342 is formed for each nozzle N. The vibration plate 36 is installed on the surface on the opposite side to the flow path substrate 32 on the pressure chamber substrate 34. The vibration plate 36 is a member with a flat plate form which is able to vibrate elastically. The vibration plate 36 is configured by, for example, a layer of an elastic film which is formed from an elastic material such as silicon oxide, and an insulation film which is formed from an insulation material such as zirconium oxide. As exemplified in FIG. 4, the space which is interposed by the vibration plate 36 and the flow path substrate 32 inside each opening section 342 of the pressure chamber substrate 34 functions as a pressure chamber (cavity) SC in which ink is retained that is supplied from the liquid retaining chamber SR via each supply flow path 324. Each pressure chamber SC is linked to the nozzle N via each linking flow path 326 of the flow path substrate 32.

Figure 5:
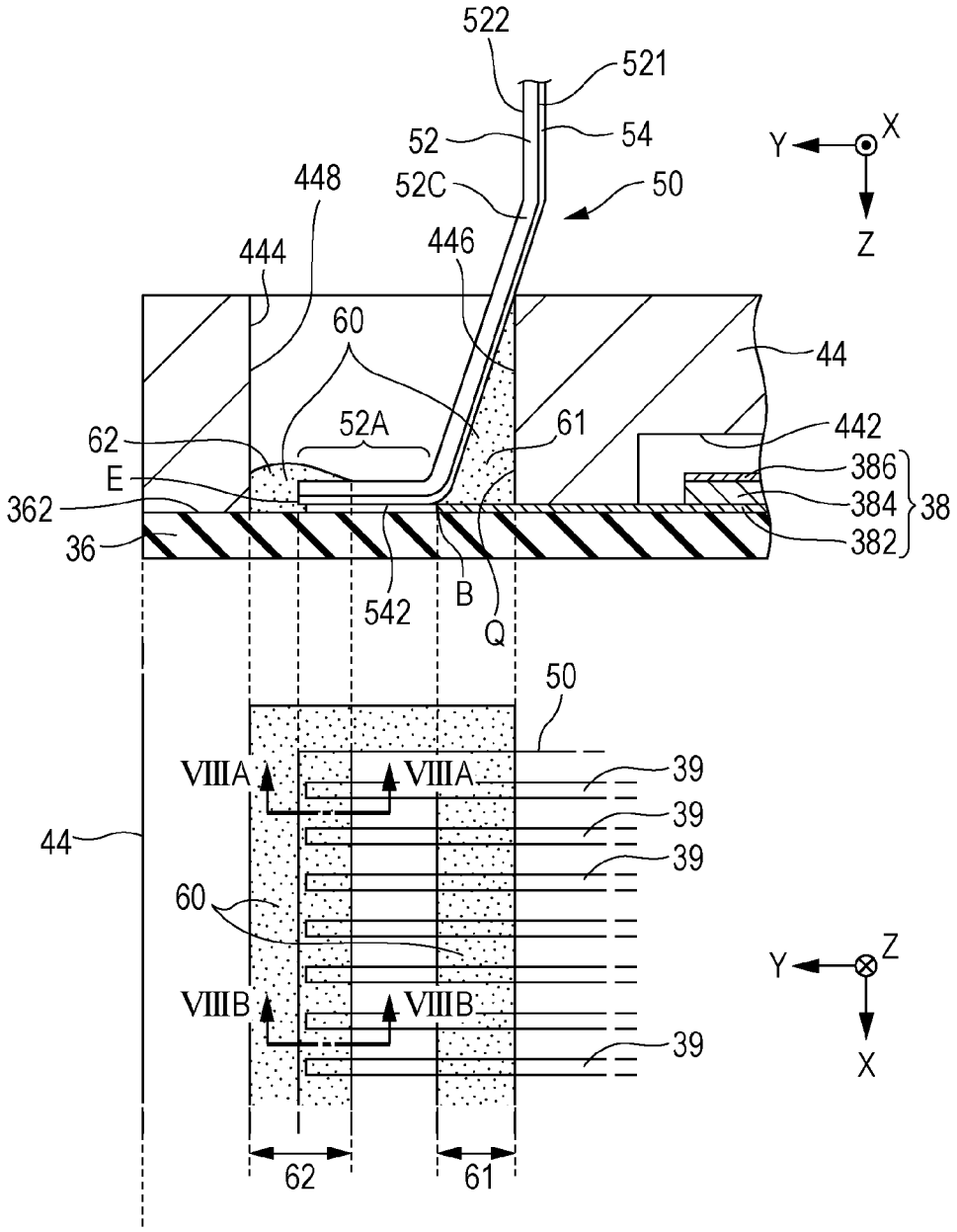
FIG. 5 is an explanatory diagram which is focused on the installation of a wiring board.

A piezoelectric element 38 is formed in each nozzle N on the surface (hereinafter referred to as an "installation surface") 362 which is opposite to the pressure chamber substrate 34 on the vibration plate 36. As exemplified in FIG. 3, a plurality of piezoelectric elements 38 are arranged in the X direction. FIG. 5 is an expanded sectional diagram and a planar diagram of the vicinity of one piezoelectric element 38 within the liquid ejecting head 30. As exemplified in the sectional diagram in FIG. 5, each of the plurality of piezoelectric elements 38 contain a first electrode 382 which is formed on a surface of the vibration plate 36, a piezoelectric body layer 384 which is formed on an upper surface of the first electrode 382, and a second electrode 386 which is formed on an upper surface of the piezoelectric body layer 384. The first electrode 382 is individually formed in each nozzle N, and the second electrode 386 links across the plurality of nozzles N. However, it is also possible to form the first electrode 382 across the plurality of nozzles N, and individually form the second electrode 386 in each nozzle N. As understood from the above explanation, the vibration plate 36 is equivalent to a specific example of the first board on which a driving element (piezoelectric element 38) is installed.

The sealing plate 44 in FIG. 4 is a structure that protects each piezoelectric element 38 (for example, prevents water, outside air, and the like coming into contact with the piezoelectric elements 38) and reinforces the mechanical strength of the pressure chamber substrate 34 and the vibration plate 36, and is fixed to the surface of the vibration plate 36 using, for example, an adhesive. Each of the plurality of piezoelectric elements 38 are accommodated in a concave section 442 which is formed on the surface opposite to the vibration plate 36 side on the sealing plate 44. As understood from the above explanation, the sealing plate 44 is equivalent to a specific example of the second board which is installed on a surface of the first board (vibration plate 36) and covers the driving element (piezoelectric element 38). The material and the production method of the sealing plate 44 are arbitrary, but, for example, it is possible to form the sealing plate 44 by injection molding of resin material. In addition, it is also possible to form the sealing plate 44 in an anticipated form with high precision by selectively removing the substrate which is configured by single crystal silicon using a semiconductor production technique.

As exemplified in FIG. 3, an opening section 444 is formed on the sealing plate 44 of the first embodiment. The opening section 444 is a through hole which extends in the X direction so as to be arranged along the plurality of piezoelectric elements 38, and as understood from FIG. 4, is positioned at the positive side in the Y direction in planar view (that is, viewed from the Z direction) with respect to each piezoelectric element 38.

As exemplified in FIG. 5, a plurality of connection terminals 39 are formed in a region (hereinafter referred to as a "mounting region") which is positioned inside the opening section 444 of the sealing plate 44 in planar view on the installation surface 362 of the vibration plate 36. Each connection terminal 39 has an electrode for supplying a driving signal for driving the piezoelectric element 38 from outside to the piezoelectric element 38, and extends from the mounting region to the negative side in the Y direction and is connected to the first electrode 382 of each piezoelectric element 38. The mounting region is a region which is interposed by a wall surface 446 and a wall surface 448 of the opening section 444 of the sealing plate 44 in planar view on the installation surface 362 of the vibration plate 36. The wall surface 446 is an inner circumferential surface which extends in the X direction to the negative side in the Y direction, and the wall surface 448 is an inner circumferential surface which extends in the X direction to the positive side in the Y direction. As exemplified in FIGS. 4 and 5, a flexible wiring board 50 is mounted in the mounting region of the installation surface 362 on the vibration plate 36.

Figure 6:
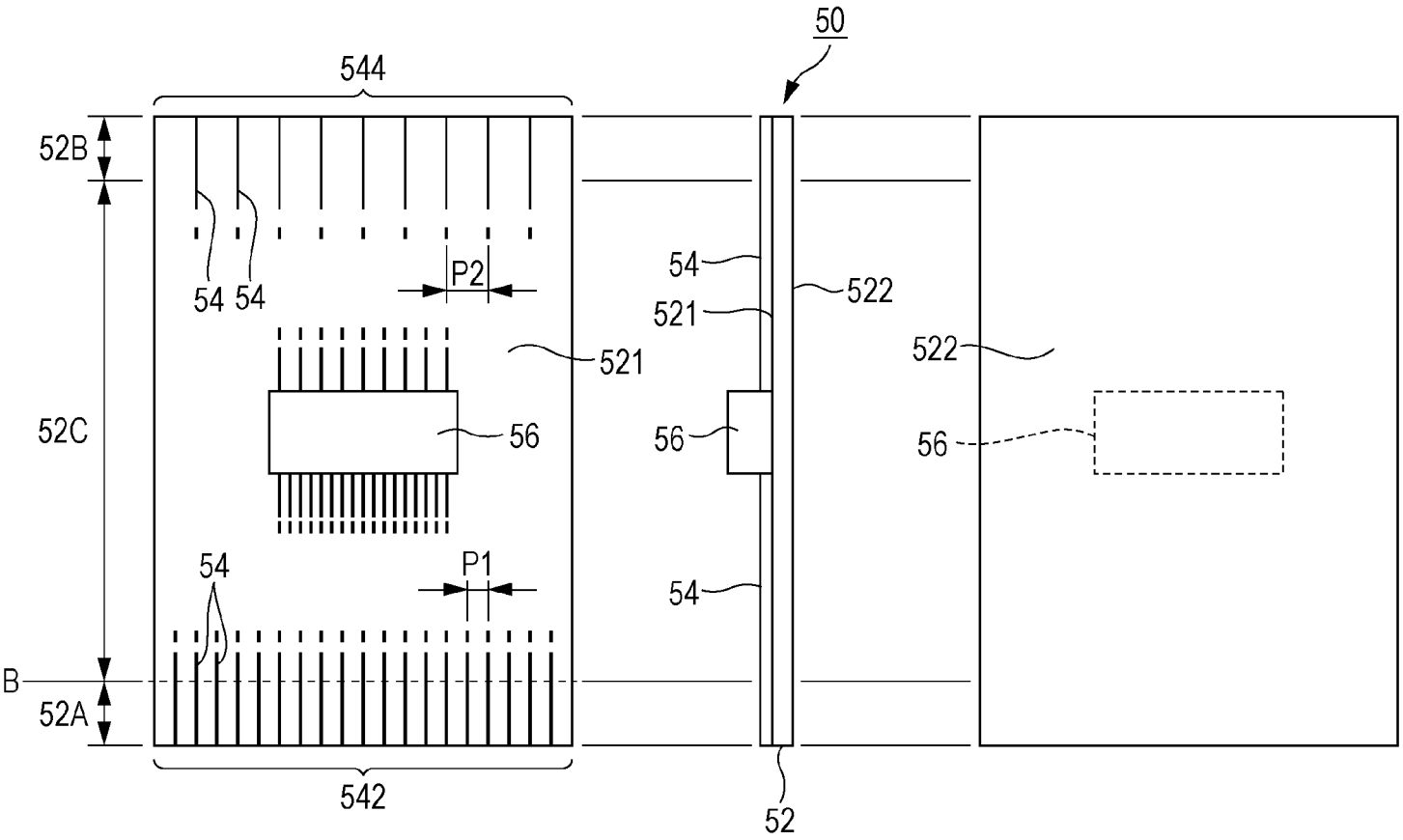
FIG. 6 is a configuration diagram of the wiring board.

FIG. 6 is a configuration diagram (front side diagram, side surface diagram, and rear surface diagram) of the wiring board 50. As exemplified in FIG. 6, the wiring board 50 of the first embodiment is a flexible printed circuit (FPC) which is equipped with a base material 52 and a plurality of wirings 54. The base material 52 is a flexible member with a flat plate form (film) which is formed using a resin material such as polyimide, and includes a first surface 521 and a second surface 522 which are positioned opposite one another. The plurality of wirings 54 are formed on the first surface 521.

Figure 7:
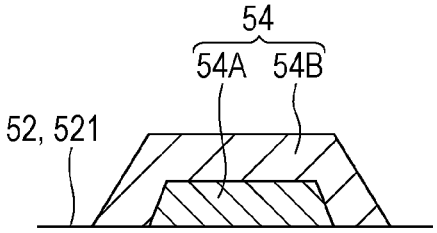
FIG. 7 is a sectional diagram of a wiring on the wiring board.

FIG. 7 is a sectional diagram of the wiring 54 on the wiring board 50. As exemplified in FIG. 7, each wiring 54 of the first embodiment is configured by layers of a first layer 54A and a second layer 54B. The first layer 54A is a conductive layer which is formed on the first surface 521 of the base material 52, and the second layer 54B is a conductive layer which is formed by plating with respect to the first layer 54A. The first layer 54A is formed, for example, using a low-resistance conductive material such as copper (Cu), and the second layer 54B protects the first layer 54A by being formed, for example, using a conductive material with high corrosion resistance such as gold (Au) or tin (Sn).

As exemplified in FIG. 6, the wiring board 50 is divided into a first end section 52A, a second end section 52B, and a center section 52C viewed from the direction perpendicular to the first surface 521. The first end section 52A is a portion which includes a peripheral edge of one side of the wiring board 50, and the second end section 52B is a portion which includes a peripheral edge of the other side. The center section 52C is a portion between the first end section 52A and the second end section 52B. As exemplified in FIG. 5, the first end section 52A of the wiring board 50 is joined to the installation surface 362 (mounting region) of the vibration plate 36.

As exemplified in FIG. 6, a portion inside the first end section 52A out of each wiring 54 on the wiring board 50 functions as a connection terminal 542, and a portion inside the second end section 52B out of each wiring 54 functions as a connection terminal 544. A plurality of connection terminals 542 are arranged in a straight-line form along the edge side of the base material 52 in the first edge section 52A, and a plurality of connection terminals 544 are arranged in a straight-line form along the edge side of the base material 52 in the second edge section 52B. In addition, an IC chip of a driving circuit 56 is mounted on the first surface 521 in the center section 52C of the base material 52. Each wiring 54 which is formed on the first surface 521 of the base material 52 electrically connects each connection terminal 542 and each connection terminal 544 to the driving circuit 56. The second end section 52B is joined to the circuit board on which the control device 22 and a power source device (which is not shown in the diagram) are mounted, and a power source voltage, which is generated by the control signal that is generated by the control device 22, and the power source device, is supplied from the circuit board to each connection terminal 544. The driving circuit 56 utilizes the control signal and the power source voltage which are supplied to the connection terminals 544, and generates a driving signal for driving each piezoelectric element 38 in each piezoelectric element 38. The driving signals which are generated in each piezoelectric element 38 by the driving circuit 56 are supplied to each connection terminal 542. As understood from the above explanation, since the connection terminals 542 are individually formed in each piezoelectric element 38, the total number of connection terminals 542 is sufficiently more than the total number of connection terminals 544. Accordingly, the plurality of connection terminals 542 are arranged in the first end section 52A at pitch (period) P1 that is narrower than a pitch P2 at which the plurality of connection terminals 544 are arranged in the second end section 52B (P1<P2).

As exemplified in FIG. 5, the first end section 52A of the wiring board 50 is joined to the installation surface 362 of the vibration plate 36 in a state in which the first surface 521 of the first end section 52A of the wiring board 50 is opposed to the installation surface 362 of the vibration plate 36. In the state in which the first end section 52A is joined to the installation surface 362, each connection terminal 542 on the first surface 521 of the first end section 52A and each connection terminal 39 on the installation surface 362 are electrically connected by being in contact with one another. That is, each piezoelectric element 38 is electrically connected to the driving circuit 56 via the connection terminal 39 and the wiring 54. For example, anisotropic conductive paste (ACP) in which conductive particles are dispersed or non-conductive paste (NCP) are utilized in joining the wiring board 50 to the installation surface 362 of the vibration plate 36.

As understood from FIG. 5, the wiring board 50 is bent at a boundary B due to being joined on the installation surface 362 such that the boundary B between the first end section 52A and the center section 52C is positioned at the wall surface 446 side (the negative side in the Y direction) of the opening section 444 on the sealing plate 44. In detail, the center section 52C of the wiring board 50 comes into contact with the wall surface 446 (upper side) of the sealing plate 44 upon being bent so as to be inclined at an obtuse angle with respect to the first end section 52A (or the installation surface 362). Accordingly, as exemplified in FIG. 5, a space Q is formed which is enclosed by the installation surface 362 of the vibration plate 36, the wall surface 446 of the sealing plate 44, and the first surface 521 of the wiring board 50 (the center section 52C). The space Q is a space with a three-dimensional form in which a central axis is approximate to a parallel triangular prism in the X direction as the bottom surface of a triangular shape which is formed by the installation surface 362 of the vibration plate 36, the wall surface 446 of the sealing plate 44, and the first surface 521 of the wiring board 50.

As understood from FIG. 5, filling material 60 is formed inside the opening section 444 of the sealing plate 44. The filling material 60 is formed using, for example, an epoxy-based adhesive. As exemplified in FIG. 5, the filling material 60 of the first embodiment includes a portion 61 and a portion 62. The portion 61 is a portion of the filling material 60 which is filled inside the space Q. Since the plurality of wirings 54 are formed on the first surface 521 which is equivalent to the inner wall surface of the space Q on the base material 52 of the wiring board 50, the portion 61 of the filling material 60 covers the wiring 54 of the first surface 521 (a portion in the vicinity of the first end section 52A). In detail, the wiring 54 is covered within the region (bent portion) with a bent shape which is bent at the boundary B of the first end section 52A and the center section 52C on the first surface 521 of the base material 52 of the wiring board 50.

Meanwhile, the portion 62 is a portion which is positioned at the positive side in the Y direction inside the opening section 444 of the sealing plate 44, and extends in the X direction (the width direction of the wiring board 50) along peripheral edge of the first end section 52A of the wiring board 50. The portion 62 of the first embodiment partially covers the side surface of the base material 52 and the second surface 522 of the wiring board 50. In addition, as understood from FIG. 5, an end surface E in a direction (positive side in the Y direction) in which the wiring 54 extends is also covered by the portion 62 of the filling material 60 out of the wiring 54 (connection terminal 542) which is formed in the first end section 52A. As ascertained from FIG. 7, since it is possible to expose the first layer 54A from the second layer 54B on the end surface E of the wiring 54, it is possible for the portion 62 of the filling material 60 to cover the first layer 54A which is exposed from the second layer 54B on the end surface E of the wiring 54.

Figure 8A:
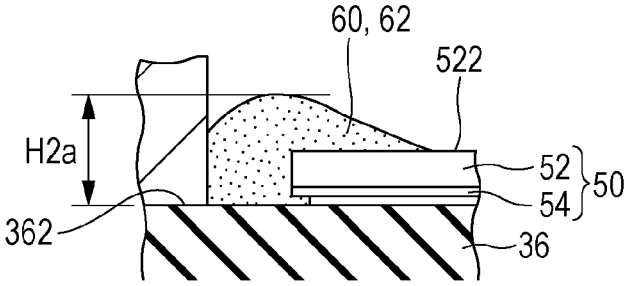
FIG. 8A and FIG. 8B are explanatory diagrams of a filling material.
Figure 8B:
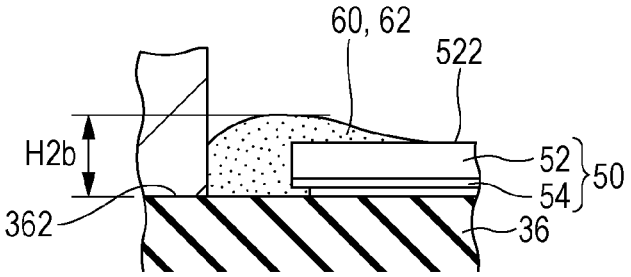

FIG. 8A and FIG. 8B are sectional diagrams which are focused on a height H2 of the portion 62 of the filling material 60. FIG. 8A is a sectional diagram along line VIIIA-VIIIA in FIG. 5, and illustrates a section of the portion 62 in the end section of the wiring board 50 in the width direction (X direction). Meanwhile, FIG. 8B is a sectional diagram along line VIIIB-VIIIB in FIG. 5, and illustrates a section of the portion 62 in the center section of the wiring board 50 in the width direction. As understood from FIG. 8, the height H2 of the portion 62 with respect to the installation surface 362 of the vibration plate 36 differs according to the position in the width direction of the wiring board 50. In detail, as understood from FIG. 8, a height H2*a* of the portion 62 in both end sections of the wiring board 50 in the width direction is more than a height H2*b* of the portion 62 in the center section in the width direction (H2*a*>H2*b*). That is, the height H2 of the portion 62 of the filling material 60 increases the closer to the end section in the width direction of the wiring board 50.

Figure 9:
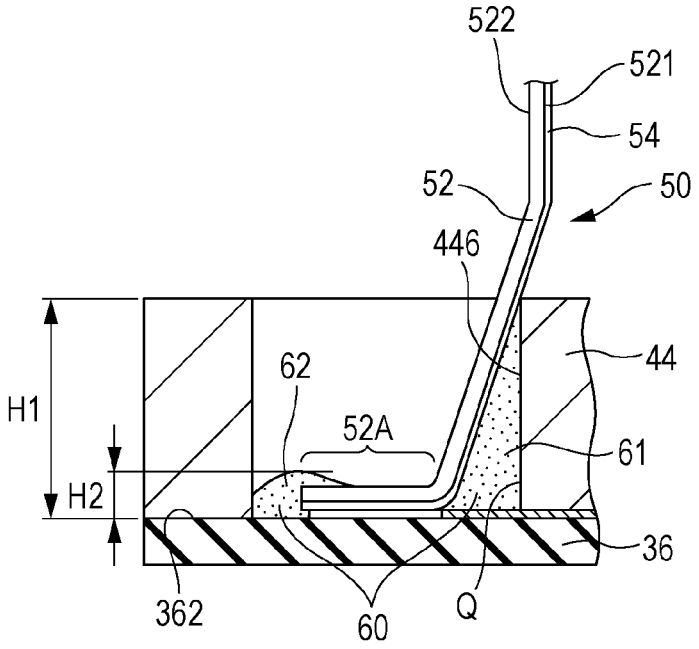
FIG. 9 is an explanatory diagram of the filling material.

FIG. 9 is an explanatory diagram of the wiring board 50 and the filling material 60 which is focused on the heights of the portion 61 and the portion 62 of the filling material 60 with respect to the installation surface 362 of the vibration plate 36. The height H2 which is illustrated in FIG. 9 is a maximum height value of the portion 62 (that is, the height H2*a* of the portion 62 in the end section of the wiring board 50 in the width direction). As understood from FIG. 9, the height H1 of the filling material 60 with respect to the installation surface 362 of the portion 61 which is positioned at the first surface 521 side of the wiring board 50 is more than the height H2 of the filling material 60 with respect to the installation surface 362 of the portion 62 which is positioned at the second surface 522 side of the wiring board 50 (H1>H2). As exemplified in FIG. 9, the height H2 of the portion 62 of the filling material 60 has a dimension to an extent of being slightly more than the second surface 522 of the first end section 52A of the wiring board 50. Meanwhile, since the portion 61 of the filling material 60 is filled in the space Q which is enclosed by the installation surface 362 of the vibration plate 36, the wall surface 446 of the sealing plate 44, and the first surface 521 of the wiring board 50 without a gap, the height H1 of the portion 61 is approximate to the height of the wall surface 446 of the sealing plate 44.

As exemplified above, In the first embodiment, the height H2 of the portion 62 of the filling material 60 which is positioned at the second surface 522 side of the wiring board 50 is suppressed to a dimension less than the height H1 of the portion 61 which is positioned at the first surface side 521. Accordingly, it is possible to suppress generation of stress which is caused by contraction of the filling material 60 in comparison to a configuration in which the filling material 60 is also formed up to an equal height at the second surface side 522 as at the first surface side 521 of the wiring board 50. For example, it is possible for an error to occur at a position of each connection terminal 39 on the installation surface 362 of the vibration plate 36 caused by contraction of the filling material 60 (thus, it is possible for a connection fault between each wiring 54 of the wiring board 50 to occur), and it is possible to reduce the potential for separation of each component which configures the liquid ejecting head 30 (for example, the flow path substrate 32, the pressure chamber substrate 34, and the nozzle plate 46) without deformation due to stress which is caused by contraction of the filling material 60. In the first embodiment, since the filling material 60 is formed such that the height H2 of the portion 62 reduces toward the center of the wiring board 50 in the width direction, the effect described above where stress which is caused by contraction of the filling material 60 is reduced is particularly remarkable in comparison to the configuration in which the portion 62 of the filling material 60 is also formed at an equal height H2*a* at the center section of the wiring board 50 in the width direction as in each end section.

Meanwhile, in the first embodiment, the height H1 of the portion 61 of the filling material 60 which is positioned at the first surface 521 side of the wiring board 50 is more than the height H2 of the portion 62 at the second surface side 522. Accordingly, the wiring 54 on the first surface 521 is covered by the filling material 60 across a wide range in comparison to a case in which the height H1 of the portion 61 of the filling material 60 at the first surface side 521 is suppressed to be an equal dimension to the height H2 of the second portion 62. Accordingly, it is possible to suppress the problem such as corrosion of the wiring 54 which is, for example, caused by coming into contact with outside air.

Figure 10:
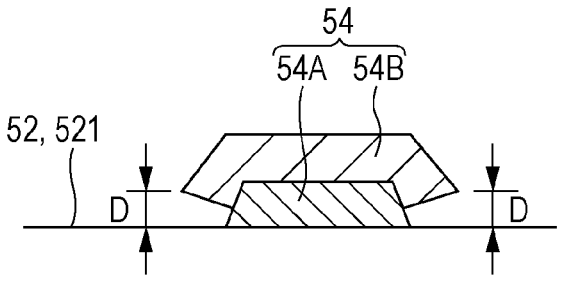
FIG. 10 is an explanatory diagram which relates to peeling of the second layer of the wiring.

As above, the wiring 54 of the first embodiment is configured by layers of a first layer 54A and a second layer 54B. The first layer 54A is sufficiently adhered to the first surface 521 of the base material 52, but the second layer 54B which is formed by plating has low adhesiveness with the base material 52. Accordingly, although it is possible to protect the first layer 54A using the second layer 54B with high corrosion resistance in a state in which the base material 52 is not bent, when the base material 52 of the wiring board 50 is bent at the boundary B between the first end section 52A and the center section 52C, as exemplified in FIG. 10, it is possible to separate the second layer 54B from the first surface 521 without deformation of the base material 52 and for the second layer 54B to come into contact with outside air by exposing the second layer 54B from a gap D between the second layer 54B and the first surface 521. In the first embodiment, since the wiring 54 on the first surface 521 is covered by the filling material 60 which is filled between the wall surface 446 of the sealing plate 44 and the first surface 521 of the wiring board 50, the first layer 54A is protected from outside air by being maintained in a state in which the first layer 54A is covered by the filling material 60 even in a case where the second layer 54B of the wiring 54 is separated from the first surface 521 caused by bending of the base material 52 in the vicinity of the boundary B. As understood from the above explanation, the configuration of the first embodiment in which the wiring 54 on the first surface 521 is formed so as to be covered by the filling material 60 (portion 61) across the boundary B is particularly preferable in a configuration in which the wiring 54 of the wiring board 50 is formed in layers of the first layer 54A and the second layer 54B.

Figure 2:
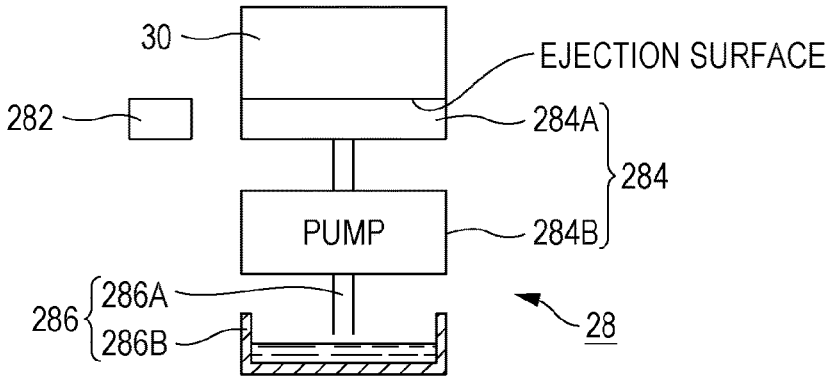
FIG. 2 is an explanatory diagram of a maintenance mechanism of the printing apparatus.

Here, in the printing apparatus 10 of the first embodiment, a vulcanized member (for example, the wiper 282, the cap 284A, the pipe body 286A, and the container 286B in FIG. 2) into which sulfur is mixed in a vulcanizing treatment is utilized from the viewpoint of securing solvent resistance with respect to liquid ink. As described above, it is possible to generate gas which contains sulfur from the vulcanized member. It is possible for sulfur which is generated from the vulcanized member to have a particularly high concentration in circumstances in which the printing apparatus 10 is sealed during transport or the like. Then, as exemplified in FIG. 10, it is possible for sulfur to be adhered to the first layer 54A via the gap D between the second layer 54B and the base material 52 in circumstances in which the first layer 54A is exposed by the second layer 54B being separated from the first surface 521 of the base material 52. Then, as exemplified in the first embodiment, copper sulfide (CuS) is generated on the surface of the first layer 54A when sulfur is reacted by being adhered to the first layer 54A which is formed from copper (Cu). Since copper sulfide is a conductive body, each connection terminal 542 is electrically shorted when each connection terminal 542 is linked by copper sulfide which is generated by adherence of sulfur. Accordingly, it is possible for adequate supply of the driving signal to be inhibited with respect to each piezoelectric element 38, and as a result, it is possible for erroneous injection of ink to occur. In particular in the first embodiment, since the boundary B is positioned at the first end section side 52A at which the plurality of connection terminals 542 are arranged at a narrower pitch P1 than the connection terminals 544 at the second end section 52B (a pitch P2), it is easy for electrical shorts to occur which are caused by generation of copper sulfide in each connection terminal 542 in comparison to each of the connection terminals 544.

In the first embodiment, since the wiring 54 on the first surface 521 is covered by the filling material 60, the first layer 54A is maintained in a state of being covered by the filling material 60 even in a case where the second layer 54B of the wiring 54 is separated from the first surface 521 caused by bending of the base material 52 in the vicinity of the boundary B. That is, even in a case where sulfur is generated from the vulcanized member, adherence of sulfur with respect to the first layer 54A of the wiring 54 (thus, generation of copper sulfide) is suppressed. Accordingly, it is advantageous in that it is possible to eliminate the problem such as shorting of each connection terminal 542 which is caused by sulfur which is generated from the vulcanized member. In particular in the first embodiment, the filling material 60 is formed using an epoxy-based adhesive with low permeability with respect to sulfur. Accordingly, the effect described above in which it is possible to prevent defects which are caused by sulfur which is generated from the vulcanized member is particularly remarkable in comparison to a case in which the filling material 60 is formed by, for example, a silicon-based adhesive which is permeable to gas which includes sulfur. As understood from the above explanation, the configuration of the first embodiment in which the filling material 60 (portion 61) is formed so as to cover the wiring 54 of the first surface 521 is particularly preferable in a configuration in which the printing apparatus 10 is equipped with the vulcanized member (typically, a configuration in which liquid ink is utilized).

Production Method

Figure 11:
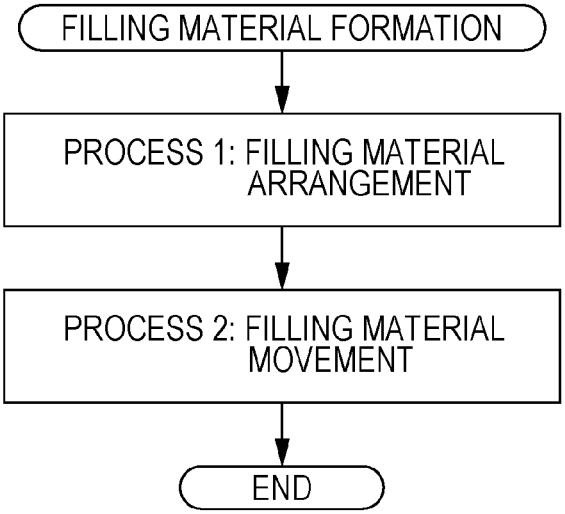
FIG. 11 is a process diagram of a method in which the filling material is formed.

A specific example of a process in which the filling material 60 is formed out of production processes of the printing apparatus 10 will be described below. FIG. 11 is an explanatory diagram of the process in which the filling material 60 is formed. The process in FIG. 11 is executed in a state in which the first end section 52A of the wiring board 50 is joined to the installation surface 362 of the vibration plate 36. As exemplified in FIG. 11, a formation procedure of the filling material 60 of the first embodiment includes Process 1 and Process 2. Process 1 is a process in which the filling material 60 is arranged on the installation surface 362 of the vibration plate 36 (inside the opening section 444 of the sealing plate 44). Process 2 is a process in which the filling material 60 which is arranged on the installation surface 362 in Process 1 is moved inside the space Q. Specific examples of each process will be given below.

Production Example A1

Figure 12:
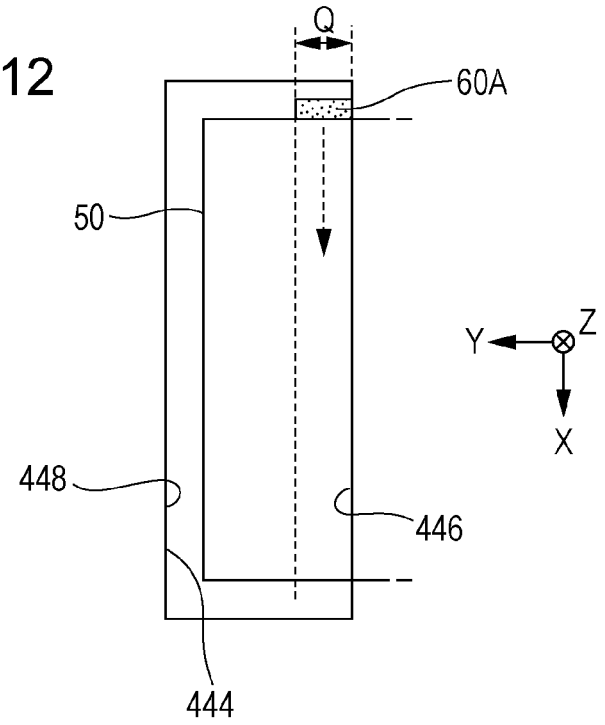
FIG. 12 is an explanatory diagram of a method (Production Example A1) in which the filling material is formed.

In Production Example A1, as exemplified in FIG. 12, a liquid filling material 60A is arranged via, for example, a straight needle-form supply pipe in the vicinity of one end section (the end section at the negative side in the X direction in the exemplification in FIG. 12) of the space Q on the installation surface 362. For example, the filling material 60A is arranged so as to block the one end section of the space Q. Immediately after Process 2, the filling material 60A is caused to enter into the space Q due to capillary force of the space Q by being maintained in the above state. The portion 61 of the filling material 60 is formed by curing the filling material 60A at a stage of reaching the entirety of the space Q. Meanwhile, the portion 62 of the filling material 60 is formed by the filling material 60A, which is arranged on the installation surface 362 in Process 1, being advanced along the peripheral edge of the wiring board 50 due to capillary force.

Here, the method for causing the filling material 60A to enter into the space Q is arbitrary. For example, it is possible to effectively cause the filling material 60A to enter into the space Q by executing vacuuming in which gas is suctioned from the space in which the liquid ejecting head 30 is installed in Process 2. In addition, a method in which the filling material 60A is caused to enter into the space Q by reducing the viscosity using heat, and a method in which the filling material 60A is caused to enter into the space Q by inclining the installation surface 362.

Production Example A2

Figure 13:
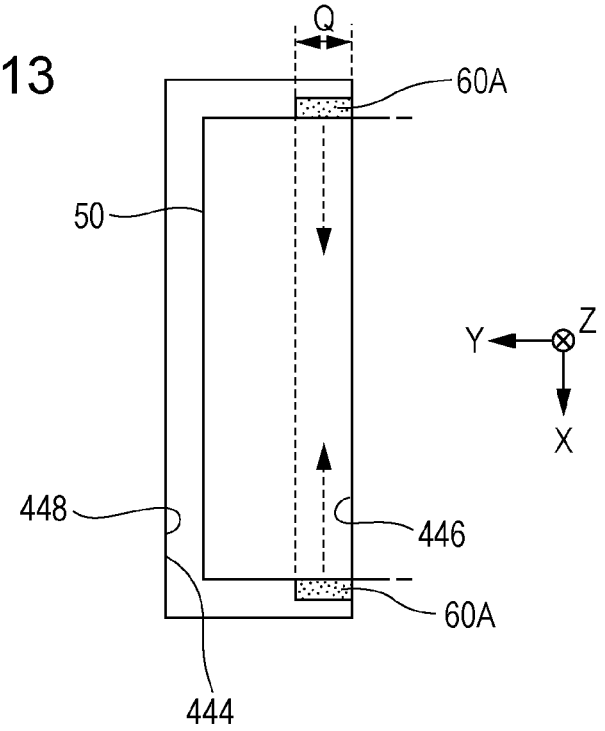
FIG. 13 is an explanatory diagram of a method (Production Example A2) in which the filling material is formed.

In Production Example A2, as exemplified in FIG. 13, the liquid filling material 60A is arranged via, for example, a straight needle-form supply pipe in the vicinity of both end sections of the space Q on the installation surface 362. The usage amount of liquid droplets is adjusted such that the filling material 60A does not form a meniscus at each end of the space Q. In Process 2, the filling material 60A is caused to into the space Q from both sides by, for example, executing vacuuming. Then, the filling material 60A is cured in a stage of reaching the entirety of the space Q. Meanwhile, the portion 62 of the filling material 60 is formed by the filling material 60A, which is arranged at both sides of the space Q in Process 1, being advanced near to the center from both sides of the wiring board 50 due to capillary force.

Other Embodiments

In Production Example A1 and Production Example A2, the filling material 60A is exemplified individually to the adhesive for joining the wiring board 50, but it is also possible to utilize an adhesive for joining the wiring board 50 to the installation surface 362 in the formation of the filling material 60. For example, it is possible to execute formation of the filling material 60 inside the space Q simultaneously to joining of the wiring board 50 with respect to the installation surface 362 by affixing an epoxy-based adhesive sheet to the first surface 521 of the first end section 52A on the wiring board 50 in advance, and pressing the first end section 52A on the installation surface 362 of the vibration plate 36.

Second Embodiment

The second embodiment of the invention will be described below. In each of the aspects exemplified below, concerning components which have the same actions and functions as the first embodiment, detailed explanation will be omitted as appropriate by using the same reference numerals which are explained in the first embodiment.

Figure 14:
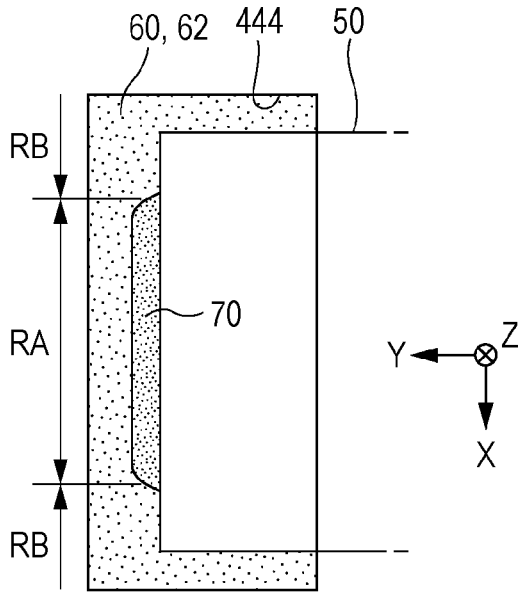
FIG. 14 is an explanatory diagram of the filling material in a second embodiment.

FIG. 14 is an expanded planar diagram of the inside of the opening section 444 of the sealing plate 44 in the second embodiment. As exemplified in FIG. 14, in the second embodiment, an adhesive (for example, an epoxy-based adhesive) 70 for joining the wiring board 50 to the installation surface 362 of the vibration plate 36 protrudes out of the region outside from between the first surface 521 of the wiring board 50 and the installation surface 362. Then, a portion of the adhesive 70 which protrudes out from between the first surface 521 and the installation surface 362 covers the end surface E of each wiring 54 and the second surface 522 of the base material 52 by being distributed across a range RA in the width direction of the wiring board 50. Meanwhile, protrusion of the adhesive 70 does not occur in a range RB outside the range RA in the width direction of the wiring board 50. Accordingly, the end surface E of each wiring 54 on the wiring board 50 and the second surface 522 of the base material 52 in the range RB are not covered by the adhesive 70. As exemplified in FIG. 14, the portion 62 of the filling material 60 of the second embodiment is not formed within each range RB. That is, the portion 62 is formed so as to cover a portion of the wiring 54 on the wiring board 50 which is not covered by the adhesive 70, and the portion 62 is not formed within the range RA in which each wiring 54 is covered by the adhesive 70.

Similar effects to those in the first embodiment are also realized in the second embodiment. In addition, in the second embodiment since the portion 62 of the filling material 60 is formed so as to cover the portion of the wiring 54 on the wiring board 50 which is not covered by the adhesive 70, the usage amount of the liquid-form filling material 60A necessary in formation of the portion 62 is reduced in comparison to the portion 62 of the filling material 60 which links across the entire region of the wiring board 50 in the width direction. Accordingly, it is advantageous in that production costs of the liquid ejecting head 30 are reduced.

Third Embodiment

Figure 15:
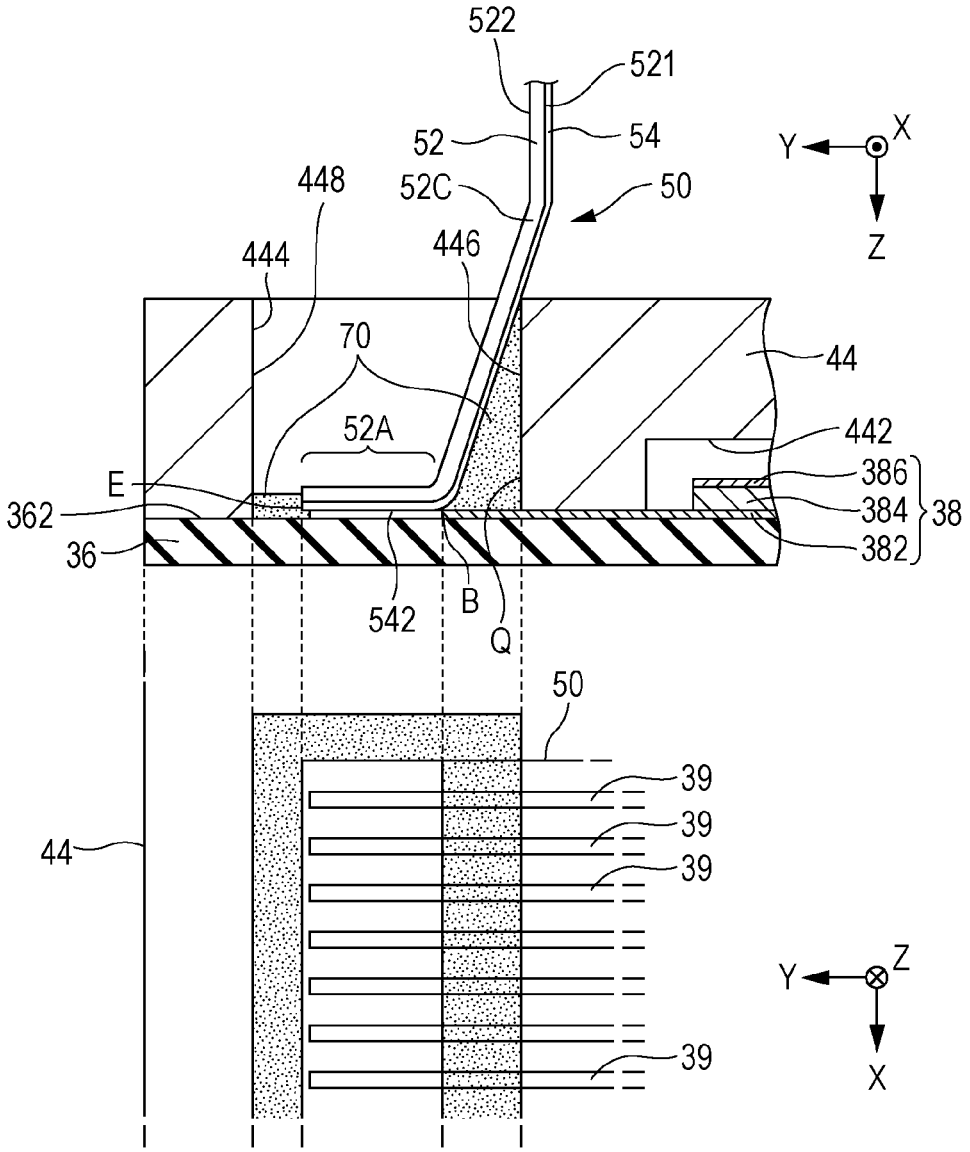
FIG. 15 is an explanatory diagram of a liquid ejecting head according to a third embodiment.

FIG. 15 is an expanded sectional diagram and a planar diagram of the vicinity of one piezoelectric element 38 within the liquid ejecting head 30 of the third embodiment. As exemplified in FIG. 15, in the third embodiment, the first end section 52A of the wiring board 50 is joined to the installation surface 362 on the vibration plate 36 using the adhesive 70. For example, anisotropic conductive paste (ACP) or non-conductive paste (NCP) is preferably utilized as the adhesive 70. As exemplified in FIG. 15, the adhesive 70 is filled into the space Q by protruding to the negative side (the wall surface 446 side of the sealing plate 44) in the Y direction from between the first end section 52A and the installation surface 362. In detail, the portion of the adhesive 70 which protrudes out to the negative side in the Y direction from between the wiring board 50 and the vibration plate 36 covers the first surface 521 of the wiring board 50 by being distributed across substantially the entire range (for example, a range including both the range RA and the range RB in FIG. 14) in the width direction on the wiring board 50. That is, in the third embodiment, the filling material is formed so as to cover the wiring 54 (that is, cover the wiring 54 of the bent portion at the boundary B on the wiring board 50) across the boundary B between the wall surface 446 of the sealing plate 44 and the first surface 521 of the wiring board 50 using the adhesive 70 in order to join the wiring board 50 and the vibration plate 36. Accordingly, similar effects to those in the first embodiment are also realized in the third embodiment. Meanwhile, the portion of the adhesive 70 which protrudes out to the positive side (the wall surface 448 side of the sealing plate 44) in the Y direction from between the wiring board 50 and the vibration plate 36 covers the end surface E of each wiring 54 of the wiring board 50.

As explained above, in the third embodiment, since the adhesive 70 for joining the wiring board 50 and the vibration plate 36 is applied as the filling material, the amount of resin material formed inside the opening section 444 of the sealing plate 44 is reduced in comparison to the first embodiment in which the filling material 60 is formed individually from the adhesive. Accordingly, it is possible to suppress stress caused by contraction of the filling material inside the opening section 44. In addition, since the filling material is formed in the process in which the wiring board 50 is joined to the vibration plate 36, it is advantageous in that the production process is simplified (thus, production costs are reduced) in comparison to the first embodiment in which the filling material 60 is formed in an individual process to the joining of the wiring board 50 and the vibration plate 36.

Production Method

A specific example of a process in which the wiring board 50 and the vibration plate 36 are joined (a process in which the filling material is simultaneously formed) out of production processes of the printing apparatus 10 of the third embodiment will be described below.

Production Example B1

Figure 16:
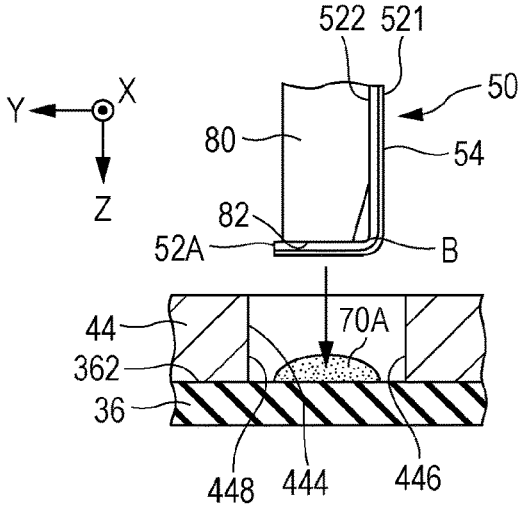
FIG. 16 is an explanatory diagram of a method (Production Example B1) in which the wiring board is mounted in the third embodiment.

In Production Example B1, as exemplified in FIG. 16, first, the liquid-form adhesive 70A is coated in the mounting region inside the opening section 444 of the sealing plate 44 out of the installation surface 362 on the vibration plate 36. In detail, the adhesive 70A is coated at a position of a substantially central point between the wall surface 446 and the wall surface 448. Meanwhile, the first side section 52A of the wiring board 50 is bent at the boundary B with respect to the center section 52C. Then, a jig 80 (mounting tool) for mounting on the wiring board 50 is moved to installation surface 362 side in a state in which a pressing surface 82 of the jig 80 comes into contact with the second surface 522 of the first end section 52A, and the adhesive 70A is caused to flow and is diffused in a direction parallel to the installation surface 362 due to the adhesive 70A pressing at the first surface 521 of the first end section 52A. Finally, the adhesive 70 in FIG. 15 is formed by curing the adhesive 70A in a state in which the first surface 521 is adhered to the installation surface 362.

Production Example B2

Figure 17:
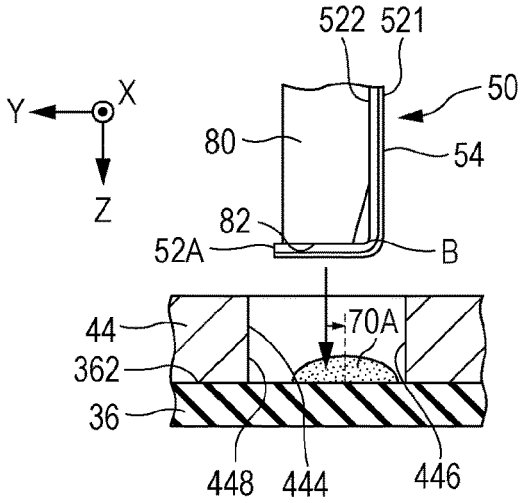
FIG. 17 is an explanatory diagram of a method (Production Example B2) in which the wiring board is mounted in the third embodiment.

In Production Example B2, as exemplified in FIG. 17, the adhesive 70A is coated at a position at the wall surface 446 side of the sealing plate 44 in comparison to Production Example B1 on the installation surface 362 of the vibration plate 36. In detail, the adhesive 70A is coated at a position a prescribed amount near to the wall surface 446 with respect to the substantially central point between the wall surface 446 and the wall surface 448. In the state above, in the same manner as Production Example B1, the jig 80 of which the pressing surface 82 comes into contact with the second surface 522 of the first end section 52A on the wiring board 50 is moved to the installation surface 362 side, and the adhesive 70 is formed by the adhesive 70A being cured in a state in which the first surface 521 is adhered to the installation surface 362. The position of the wiring board 50 and the jig 80 with respect to the vibration plate 36 is similar to Production Example B1. As exemplified above, in Production Example B2, since the adhesive 70A is coated at the wall surface 448 side in comparison to Production Example B1, it is advantageous in that it is easy to cover the portion of the wiring board 50 which is bent at the boundary B using the adhesive 70.

Production Example B3

Figure 18:
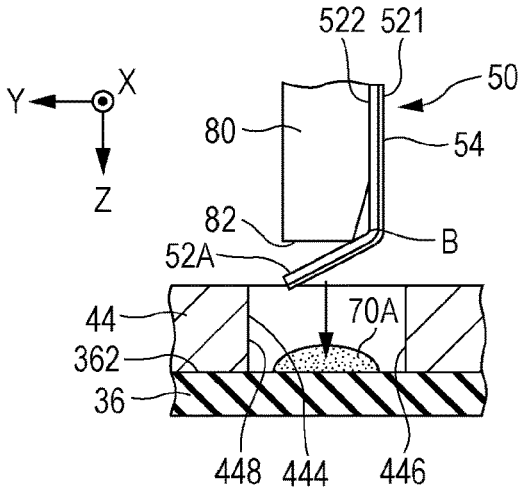
FIG. 18 is an explanatory diagram of a method (Production Example B3) in which the wiring board is mounted in the third embodiment.

In Production Example B1 and Production Example B2, the first end section 52A of the wiring board 50 is bent substantially perpendicularly with respect to the center section 52C, but in Production Example B3, as exemplified in FIG. 18, the first end section 52A of the wiring board 50 is bent at the boundary B so as to form an obtuse angle with respect to the first end section 52A and the center section 52C. As above, the jig 80 which comes into contact with the second surface 522 is caused to approach the wiring board 50 and the installation surface 362 in a state in which the first end section 52A is inclined with respect to the installation surface 362 of the vibration plate 36 (that is, intersects at a non-perpendicular angle). Accordingly, the adhesive 70A which is coated on the installation surface 362 is scraped out at the wall surface 446 side of the sealing plate 44 by being pressed by the first surface 521 of the first end section 52. Meanwhile, the first end section 52A of the wiring board 50 approaches in a state of being substantially orthogonal to the center section 52C by coming into contact with and approaching the installation surface 362. After the process above, the adhesive 70 in FIG. 15 is formed by curing the adhesive 70A in a state in which the first surface 521 is adhered to the installation surface 362. In Production Example B3 in the same manner as in Production Example B2, it is possible to effectively aggregate the adhesive 70A at the wall surface 446 side.

Other Embodiments

In Production Example B1 to Production Example B3, the adhesive 70A is coated on the installation surface 362 of the vibration plate 36, but it is also possible to install the anisotropic conductive paste (ACP) or an anisotropic conductive film (ACF) in advance on the first surface 521 of the first end section 52A of the wiring board 50 as the adhesive 70A, and form the adhesive 70 by pressing the first end section 52A on the installation surface 362 using the jig 80.

Fourth Embodiment

Figure 19:
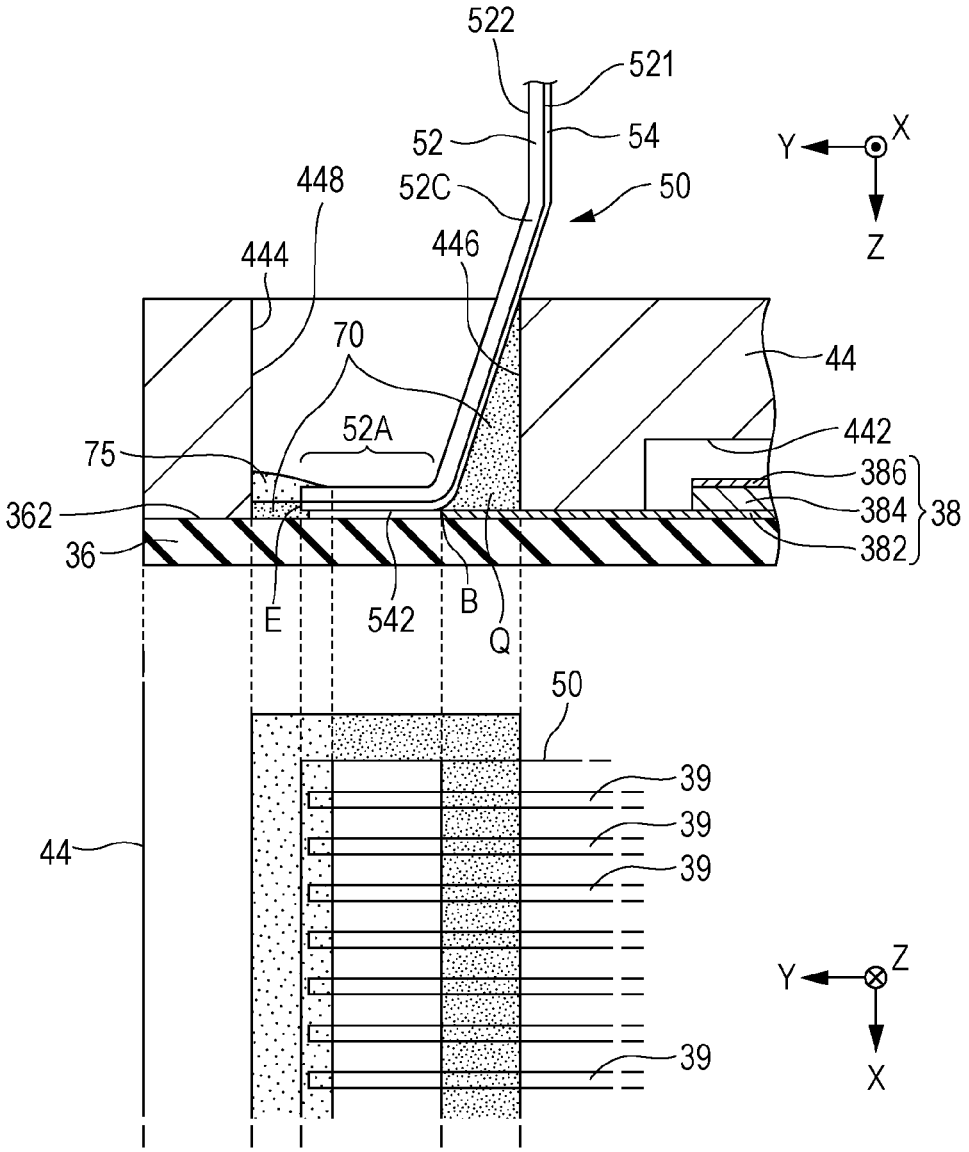
FIG. 19 is a configuration diagram of a liquid ejecting head according to a fourth embodiment.

FIG. 19 is an expanded sectional diagram and a planar diagram of the vicinity of one piezoelectric element 38 within the liquid ejecting head 30 of the fourth embodiment. As exemplified in FIG. 19, in the fourth embodiment, a coating material 75 is formed (for example, potted) in addition to the adhesive 70 in the same manner as the third embodiment. The coating material 75 is formed using, for example, an epoxy-based adhesive which has low permeability with respect to gas such as sulfur, and extends along the width direction (X direction) of the wiring board 50. The coating material 75 which is exemplified in FIG. 19 covers the adhesive 70 between the leading end of the first end section 52A of the wiring board 50 and the wall surface 448 of the sealing plate 44, and covers the second surface 522 of the first end section 52A (a portion at the leading end side). Accordingly, the end surface E, which is exposed from the adhesive 70 out of each wiring 54 on the wiring board 50, is covered by the coating material 75.

Similar effects to those in the third embodiment are also realized in the fourth embodiment. In addition, in the fourth embodiment, since the coating material 75 is formed in addition to the adhesive 70, it is advantageous in that it is possible to effectively protect the end surface E and suppress corrosion and the like using the coating material 75 even in a case in which, for example, the end surface E of each wiring 54 on the wiring board 50 is exposed from the adhesive 70.

Here, in the third embodiment and the fourth embodiment, a configuration in which the adhesive 70 is not formed on the surface of the second surface 522 of the first end section 52A on the wiring board 50 is exemplified, but it is also possible to form the adhesive 70 so as to partially cover the second surface 522 of the first end section 52A. According to the configuration in which the adhesive 70 covers the second surface 522, it is advantageous in that it is possible to effectively protect the end section E of each wiring 54 without the need to form the coating material 75 which is exemplified, for example, in the fourth embodiment.

Meanwhile, in the configuration in which the adhesive 70 covers the second surface 522, it is possible to adhere the adhesive 70 (the adhesive 70A prior to curing) on the second surface 522 to the jig 80 in a process in which the wiring board 50 is joined to the installation surface 362. As in the third embodiment and the fourth embodiment, according to the configuration in which the adhesive 70 is not formed on the surface of the second surface 522, it is advantageous in that it is possible to prevent adherence of the adhesive 70 with respect to the jig 80, even in a case in which, for example, the adhesive 70A is excessively coated.

Here, it is possible for the filling material which is formed using the adhesive 70 in the third embodiment and the fourth embodiment to satisfy the condition ($H2a>H2b$, $H1>H2$) exemplified in the first embodiment, but it is also possible to adopt a configuration in which the condition is not satisfied. In addition, in the third embodiment and the fourth embodiment, as long as the filling material which covers each wiring 54 is formed between the installation surface 362 on the vibration plate 36 and the wall surface 446 of the sealing plate 44, the form of the space Q is not an essential condition.

Modification Example

It is possible for each aspect which is exemplified above to be variously modified. Specific modified aspects will be exemplified in detail below. It is possible to appropriately combine two or more aspects which are arbitrarily selected from the above exemplifications within a range which is not mutually inconsistent.

(1) In each of the aspects above, the filling material 60 which includes the portion 61 at the first surface 521 side (the inside of the space Q) and the portion 62 at the second surface 522 side (the outside of the space Q) of the wiring board 50 is exemplified, but it is also possible to omit the portion 62, and configure the filling material 60 with only the portion 61 which is filled inside the space Q. That is, the condition described above in which the height H1 of the portion 61 of the filling material 60 at the first surface side 521 is more than the height H2 of the portion 62 at the second surface 522 side includes a case in which the height H2 of the portion 62 is a prescribed positive number as well as a case in which the height H2 is zero (a configuration in which the portion 62 is omitted).

Figure 20:
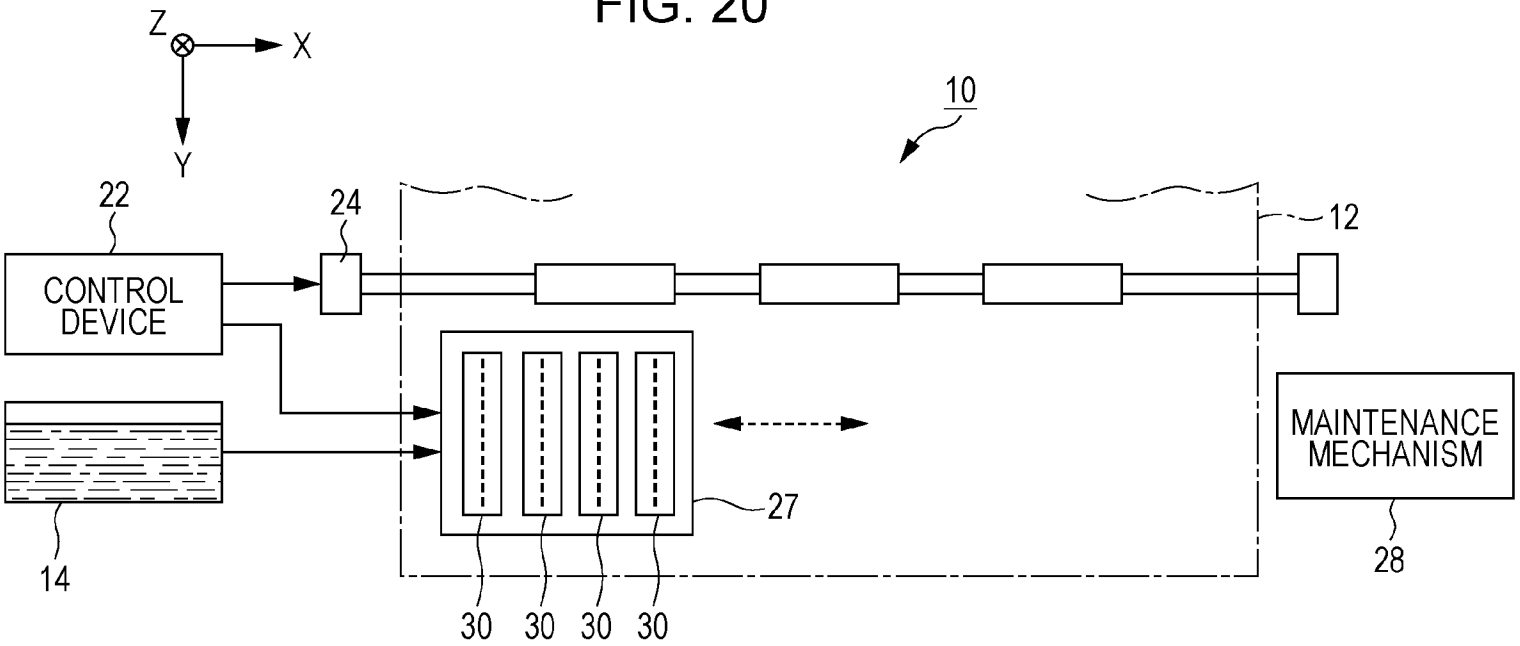
FIG. 20 is a configuration diagram of a printing apparatus according to a modification example.

(2) In each of the aspects described above, a line head is exemplified where the plurality of liquid ejecting heads 30 are arranged in the X direction which is orthogonal to the Y direction in which the medium 12 is transported, but it is possible to also apply the invention to a serial head. For example, as exemplified in FIG. 20, each of the liquid ejecting heads 30 eject ink onto the medium 12 while a carriage 27, on which the plurality of liquid ejecting heads 30 according to each of the aspects described above are mounted, moves back and forth in the X direction under control by the control device 22.

Figure 21:
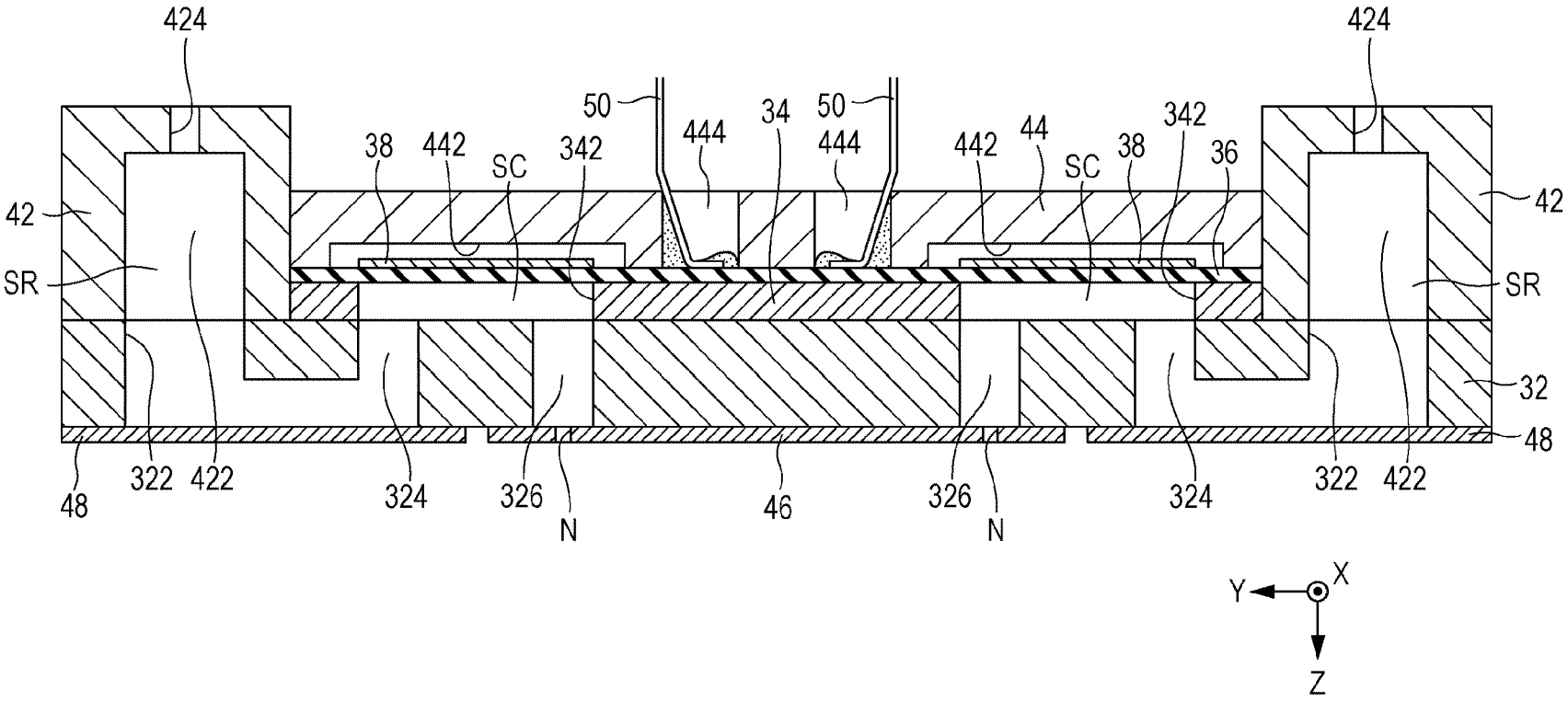
FIG. 21 is a sectional diagram of a liquid ejecting head according to a modification example.

(3) In each of the aspects described above, the liquid ejecting head 30 is exemplified in which the plurality of nozzles N are arranged in one row, but as exemplified in FIG. 21, it is also possible to realize the liquid ejecting head in which ink is ejected from two rows of the nozzles N by arranging the configuration substantially line symmetrically in the same manner as each of the aspects described above. Here, concerning the two rows of the nozzles N exemplified in FIG. 21, it is also possible to adopt a configuration in which one row is formed on the wiring board 50 and one row is formed in the opening section 444 (that is, a configuration in which the wiring board 50 and the opening section 444 are made common by the two rows of the nozzles N).

(4) The components (driving elements) which vary the pressure inside the pressure chamber SC are not limited to the piezoelectric elements 38 exemplified in each embodiment described above. For example, it is also possible to utilize an oscillator such as an electrostatic actuator as the driving element. In addition, the driving elements are not limited to components which impart mechanic vibration to the pressure chambers SC. For example, it is also possible to utilize a heat generating element (heater), which varies the pressure by generating bubbles inside the pressure chambers SC by heating, as the driving element. As understood from the exemplification above, the driving elements are comprehensively expressed as components for ejecting liquid (typically elements which apply pressure inside the pressure chambers SC), and neither the operating method (piezo method/thermal method) nor the detailed configuration are relevant.

(5) It is possible to adopt the printing apparatus 10 which is exemplified in each of the aspects above in various devices, other than a device which is specialized for printing, such as a facsimile apparatus or a copy machine. However, the applications of the liquid ejecting apparatus of the invention are not limited to printing. For example, a liquid ejecting apparatus which ejects color liquid is utilized as a manufacturing apparatus which forms a color filter of a liquid crystal display apparatus. In addition, a liquid ejecting apparatus which ejects a conductive material solution is utilized as a manufacturing apparatus which forms an electrode and a wiring of a wiring substrate.

What is claimed is:

1. A liquid ejecting head comprising:

a first board on which a driving element for ejecting liquid is installed;

a second board which is installed on a surface of the first board and covers the driving element;

wiring board that includes a first surface on which a wiring, where a driving signal is supplied to the driving element, is formed and a second surface that is at a side opposite to a side of the first surface, the wiring board further including a first end section joined to the surface of the first board at the first surface side, the wiring board also including a center section inclined with respect to the first end section toward a wall surface of the second board; and a filling material which covers the wiring by being formed at least between the first surface and the wall surface of the second board, wherein a first height of the filling material at the first surface side with respect to the surface of the first board is high in comparison to a second height of the filling material at the second surface side, wherein the filling material is filled inside a space enclosed by the first board, the wall surface of the second board, and the center section, and wherein the second height of the filling material at the second surface side with respect to the surface of the first board continuously varies in height such that the second height is low in a center region of the first end section of the wiring board in a width direction in comparison to an end region of the first end section of the wiring board in the width direction.

2. A liquid ejecting head comprising:

a first board on which a driving element for ejecting liquid is installed;

a second board which is installed on a surface of the first board and covers the driving element;

wiring board that includes a first surface on which a wiring, where a driving signal is supplied to the driving element, is formed and a second surface that is at a side opposite to a side of the first surface, the wiring board further including a first end section joined to the surface of the first board at the first surface side, the wiring board also including a center section inclined with respect to the first end section toward a wall surface of the second board; and a filling material which covers a bent portion of the wiring board between the first end section and the center section, a first height of the filling material at the first surface side being higher than a second height of the filling material at the second surface side, wherein the filling material is filled inside a space enclosed by the first board, the wall surface of the second board, and the center section, and wherein the second height of the filling material at the second surface side with respect to the surface of the first board continuously varies in height such that the second height is low in a center region of the first end section of the wiring board in a width direction in comparison to an end region of the first end section of the wiring board in the width direction.

3. The liquid ejecting head according to claim 1, wherein the wiring on the wiring board includes a first layer and second layer which is formed by plating with respect to the first layer.

4. The liquid ejecting head according to claim 1, wherein the filling material is formed by an epoxy-based adhesive.

5. The liquid ejecting head according to claim 1, wherein the wiring board includes the first end section in which a plurality of connection terminals are arranged at a first pitch and a second end section in which a plurality of connection terminals are arranged at a second pitch which is wider than the first pitch, and the filling material covers the first end section.

6. The liquid ejecting head according to claim 1, wherein the filling material covers an end surface of the wiring board in a direction in which the wiring extends.

7. The liquid ejecting head according to claim 1, wherein the first end section of the wiring board is joined to an installation surface using an adhesive, and the filling material covers a portion of the wiring on the wiring board, the position not being covered by the adhesive.

8. A liquid ejecting apparatus comprising the liquid ejecting head according to claim 1.

9. A liquid ejecting apparatus comprising the liquid ejecting head according to claim 2.

10. The liquid ejecting apparatus according to claim 8, further comprising:

a vulcanized member.

11. A production method of a liquid ejecting head which includes a first board on which a driving element for ejecting liquid is installed, a second board which is installed on a surface of the first board and covers the driving element, and a wiring board that includes a first surface on which a wiring, where a driving signal is supplied to the driving element, is formed and a second surface that is at a side opposite to a side of the first surface, the wiring board further including a first end section joined to the surface of the first board at the first surface side, the wiring board also including a center section inclined with respect to the first end section toward a wall surface of the second board, wherein a first height of the filling material at the first surface side is higher than a second height of the filling material at the second surface side, and wherein the second height of the filling material at the second surface side with respect to the surface of the first board continuously varies in height such that the second height is low in a center region of the first end section of the wiring board in a width direction in comparison to an end region of the first end section of the wiring board in the width direction, the method comprising:

arranging the filling material on the first surface of the first board; and moving the filling material inside a space which is enclosed by the first board, the wall surface of the second board, and the center section.

12. A production method of a liquid ejecting head which includes a first board on which a driving element for ejecting liquid is installed, a second board which is installed on a surface of the first board and covers the driving element, and a wiring board that includes a first surface on which a wiring, where a driving signal is supplied to the driving element, is formed and a second surface that is at a side opposite to a side of the first surface, the wiring board further including a first end section joined to the surface of the first board at the first surface side, the wiring board also including a center section inclined with respect to the first end section toward a wall surface of the second board, wherein a first height of the filling material at the first surface side is higher than a second height of the filling material at the second surface side, and wherein the second height of the filling material at the second surface side with respect to the surface of the first board continuously varies in height such that the second height is low in a center region of the first end section of the wiring board in a width direction in comparison to an end region of the first end section of the wiring board in the width direction, the method comprising:

joining the wiring board and the first board using an adhesive; and covering a bent portion of the wiring board between the first surface and the wall surface of the second board with the adhesive, wherein the adhesive is filled inside a space which is enclosed by the first board, the wall surface of the second board, and the center section.

13. The liquid ejection head according to claim 1, wherein the space forms a triangular shape.

14. The liquid ejection head according to claim 2, wherein the space forms a triangular shape.

15. The method according to claim 11, wherein the space forms a triangular shape.

16. The method according to claim 12, wherein the space forms a triangular shape.

17. The liquid ejection head according to claim 1, wherein the driving element includes at least a first electrode formed between the first and second boards, wherein the driving signal is supplied to the first electrode, and wherein the filling material covers the wiring by being formed at least between the first surface, the wall surface of the second board, and the first electrode of the driving element.

18. The liquid ejection head according to claim 2, wherein the driving element includes at least a first electrode formed between the first and second boards, wherein the driving signal is supplied to the first electrode, and wherein the filling material covers the first electrode.

* * * * *